US007420517B2

(12) United States Patent
Oshima et al.

(10) Patent No.: US 7,420,517 B2
(45) Date of Patent: Sep. 2, 2008

(54) HIGH FREQUENCY WAVE GLASS ANTENNA FOR AN AUTOMOBILE AND REAR WINDOW GLASS SHEET FOR AN AUTOMOBILE

(75) Inventors: Kiyoshi Oshima, Chiyoda-ku (JP); Osamu Kagaya, Chiyoda-ku (JP); Koji Ikawa, Chiyoda-ku (JP); Toshifumi Funatsu, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 11/736,219

(22) Filed: Apr. 17, 2007

(65) Prior Publication Data

US 2007/0247379 A1 Oct. 25, 2007

(30) Foreign Application Priority Data

Apr. 19, 2006 (JP) ..... 2006-115701

(51) Int. Cl.
*H01Q 1/32* (2006.01)

(52) U.S. Cl. ..... 343/711

(58) Field of Classification Search ..... 343/711–713, 343/726, 728, 741–744, 748
See application file for complete search history.

(56) References Cited

U.S. PATENT DOCUMENTS 3,771,159 A * 11/1973 Kawaguchi et al. ..... 343/729
5,113,195 A * 5/1992 Sakurai et al. ..... 343/704
5,285,210 A * 2/1994 Sato et al. ..... 343/713
5,831,580 A * 11/1998 Taniguchi et al. ..... 343/713
5,952,977 A * 9/1999 Taniguchi et al. ..... 343/713
6,002,373 A * 12/1999 Taniguchi et al. ..... 343/713
7,091,914 B2 * 8/2006 Noguchi et al. ..... 343/713
2003/0137442 A1 7/2003 Baliarda
2005/0030235 A1 * 2/2005 Noguchi et al. ..... 343/713
2007/0273597 A1 * 11/2007 Noda ..... 343/713

FOREIGN PATENT DOCUMENTS

JP 2-139161 11/1990

(Continued)

OTHER PUBLICATIONS

John McVay, et al., "Small Dipole Antenna near Peano High-Impedance Surfaces", IEEE, 2004, pp. 1-4.

(Continued)

*Primary Examiner*—Huedung Mancuso
(74) *Attorney, Agent, or Firm*—Oblon, Spivak, McClelland, Maier & Neustadt, P.C.

(57) ABSTRACT

A plurality of heating wires 2 have a plurality of detours 1 formed therein, the heating wires 2 have inlets 10 formed therein for connection with the detours 1, and both ends of each of the inlets 10 and both ends of each of the detours 1 are connected by a pair of connection lines 9. When a shorter one of the shortest spacing between the paired connection lines 9 and the shortest spacing between both ends of the inlets 10 is called $W_e$, when the maximum width of the detours 1 in a horizontal direction is called $W_r$, when a received frequency has a wavelength of $\lambda_0$ in the air, and when the formula of $\{(W_r-W_e)/2\}=L_1$ is established, the formula of $L_1 \geqq 0.0053 \cdot \lambda_0$ is satisfied.

43 Claims, 11 Drawing Sheets

FOREIGN PATENT DOCUMENTS

| | | |
|---|---|---|
| JP | 2002-135025 | 5/2002 |
| JP | 2003-283405 | 10/2003 |
| JP | 2006-117026 | 5/2006 |
| WO | WO 2004/075342 A1 | 9/2004 |
| WO | WO 2006/001486 A1 | 1/2006 |

OTHER PUBLICATIONS

Jinhui Zhu, et al., "Mutual Coupling Effects in Space-Filling-Curve Antennas", IEEE, 2003, pp. 1-2.

* cited by examiner

HIGH FREQUENCY WAVE GLASS ANTENNA FOR AN AUTOMOBILE AND REAR WINDOW GLASS SHEET FOR AN AUTOMOBILE

BACKGROUND OF THE INVENTION

1. Field of the Invention

The present invention relates to a high frequency wave glass antenna for an automobile, which is appropriate to receive a digital terrestrial television broadcast in Japan (470 to 770 MHz), a UHF band analog television broadcast (473 to 767 MHz), a US digital television broadcast (698 to 806 MHz) or a UHF band (300 MHz to 3 GHz). The present invention also relates to a rear window glass sheet for an automobile, which includes the above-mentioned high frequency wave glass antenna for an automobile.

2. Discussion of Background

There has been known a high frequency wave glass antenna for an automobile as shown in FIG. 2, which is utilized for receiving a digital television broadcast (see, e.g., WO 2006/001486, page 1 and FIG. 1). In this prior art, a rear window glass sheet 14 includes a defogger, which comprises a plurality of heating wires 33 and bus bars 35, and the rear window also includes an antenna conductor 31 and a feeding point 32. The heating wire 34 at the highest position just under the antenna conductor 31 is formed in a meander shape. This arrangement reduces the adverse effect of the heating wires 33 and 34 on the antenna conductor 31 in a digital television broadcast band, improving the antenna gain in the digital television broadcast band.

However, this prior art has caused a problem in that the degree of reduction in the adverse effect of the heating wires 33 and 34 on the antenna conductor 31 is small in the digital television broadcast band, and that the improvement in the antenna gain in the digital television broadcast band is insufficient. This prior art has caused another problem in that the defogger is not compact in a vertical direction since the vertical width of the meander shape needs to be extended in order to improve the antenna gain.

SUMMARY OF THE INVENTION

It is an object of the present invention to solve the above-mentioned problems of the prior art and to provide a high frequency wave glass antenna for an automobile, which has not been known yet.

The present invention is proposed to attain the above-mentioned object. The present invention provides a high frequency wave glass antenna for an automobile, comprising a plurality of heating wires and a plurality of bus bars for feeding the heating wires, disposed in or on an automobile rear widow glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper margin of the rear widow glass sheet except for a defogger region;

further comprising:

at least one of the heating wires having a detour formed at one or more locations therein;

a heating wire with the detour, having an inlet connected to the detour; and both ends of the inlet connected to both ends of the detour directly or through a pair of connection lines;

wherein in a case where both ends of the inlet are connected to both ends of the detour through the paired connection lines, a shorter one of the shortest spacing between the paired connection lines and the shortest spacing between both ends of the inlet is called $W_e$;

in a case where both ends of the inlet are connected to both ends of the detour directly, the shortest spacing between both ends of the inlet is called $W_e$;

when the maximum width of the detour in a horizontal direction is call $W_r$, a received frequency has $\lambda_0$ in the air, and the formula of $\{(W_r-W_e)/2\}=L_1$ is established, the formula of $L_1 \geqq 0.0053 \cdot \lambda_0$ is satisfied.

The present invention also provides a high frequency wave glass antenna for an automobile, comprising a plurality of heating wires and a plurality of bus bars for feeding the heating wires, disposed in or on an automobile rear widow glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper margin of the rear widow glass sheet except for a defogger region;

further comprising:

the highest heating wire and the second highest heating wire just under the highest heating wire, which are disposed in a central portion of the rear window glass sheet in a left-to-right direction, and which have leading edges connected by a short-circuit heating wire without reaching one of the bus bars;

a joining heating wire extending toward the one bus bar, beginning at the short-circuit heating wire, and reaching and being connected to the one bus bar;

a detour formed at one or more locations in the joining heating wire;

the joining heating wire having an inlet connected to the detour; and both ends of the inlet connected to both ends of the detour directly or through a pair of connection lines;

wherein in a case where both ends of the inlet are connected to both ends of the detour through the paired connection lines, a shorter one of the shortest spacing between the paired connection lines and the shortest spacing between both ends of the inlet is called $W_e$; and in a case where both ends of the inlet are connected to both ends of the detour directly, the shortest interval between both ends of the inlet is called $W_e$;

when the maximum width of the detour in a horizontal direction is call $W_r$, a received frequency has $\lambda_0$ in the air, and the formula of $\{(W_r-W_e)/2\}=L_1$ is established, the formula of $L_1 \geqq 0.0053 \cdot \lambda_0$ is satisfied.

In accordance with the present invention, a heating wire, which is disposed in or on the rear window glass sheet under the antenna conductor, has a detour formed so as to meet the predetermined conditions. Accordingly, the defogger is sufficiently difficult to have an adverse effect on the antenna performance of the antenna conductor, significantly improving the antenna gain with respect to a digital terrestrial television broadcast, a US digital television broadcast, etc. Further, since it is possible to improve the antenna gain even if the vertical width of the detour is small, the detour can be made compact in the vertical direction, making it difficult to damage the visual field of the rear window glass sheet, in particular, the visual field and the aesthetic appearance of a defogger region.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
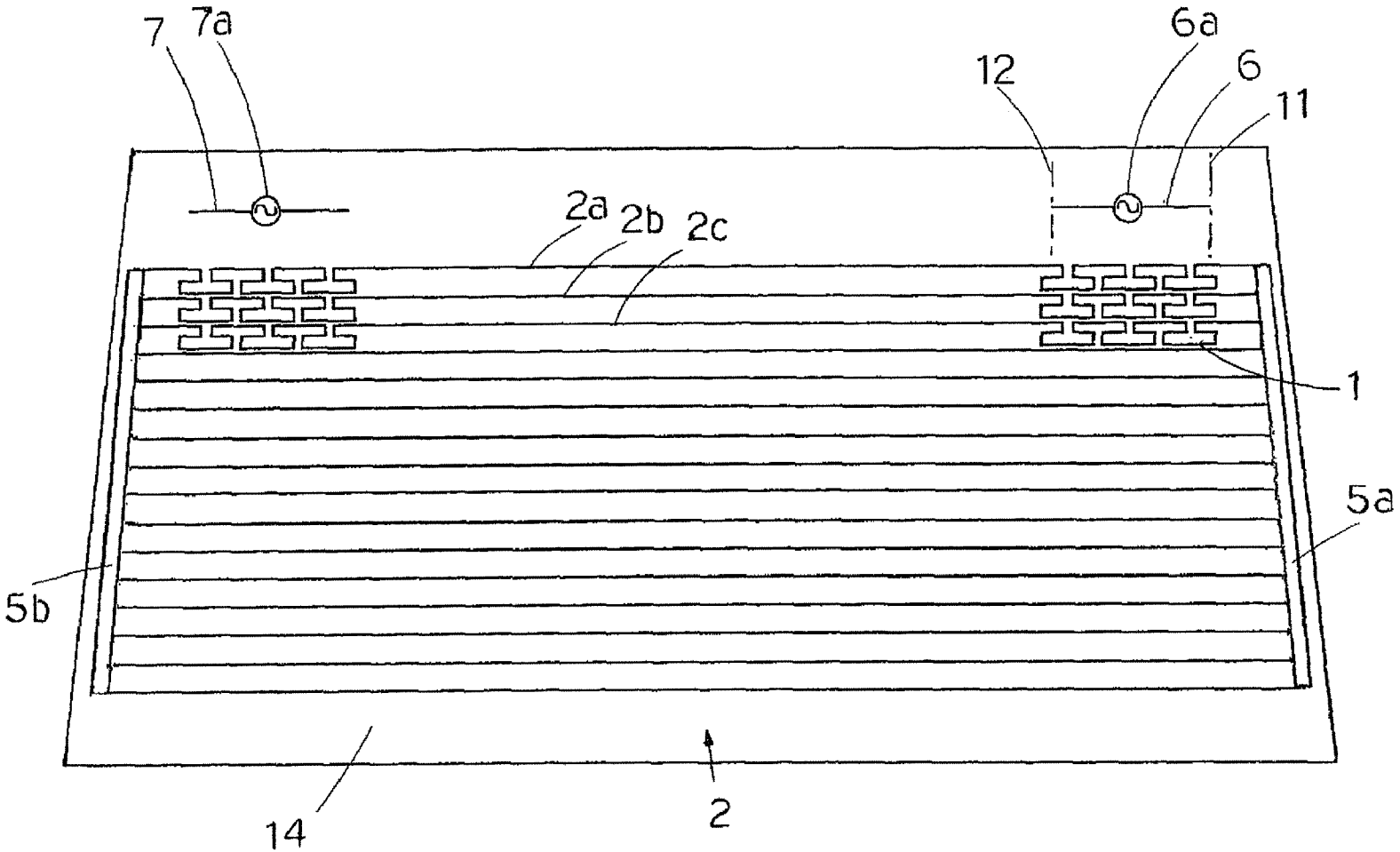
FIG. 1 is a plan view showing the high frequency wave glass antenna for an automobile according to an embodiment of the present invention.
Figure 2:
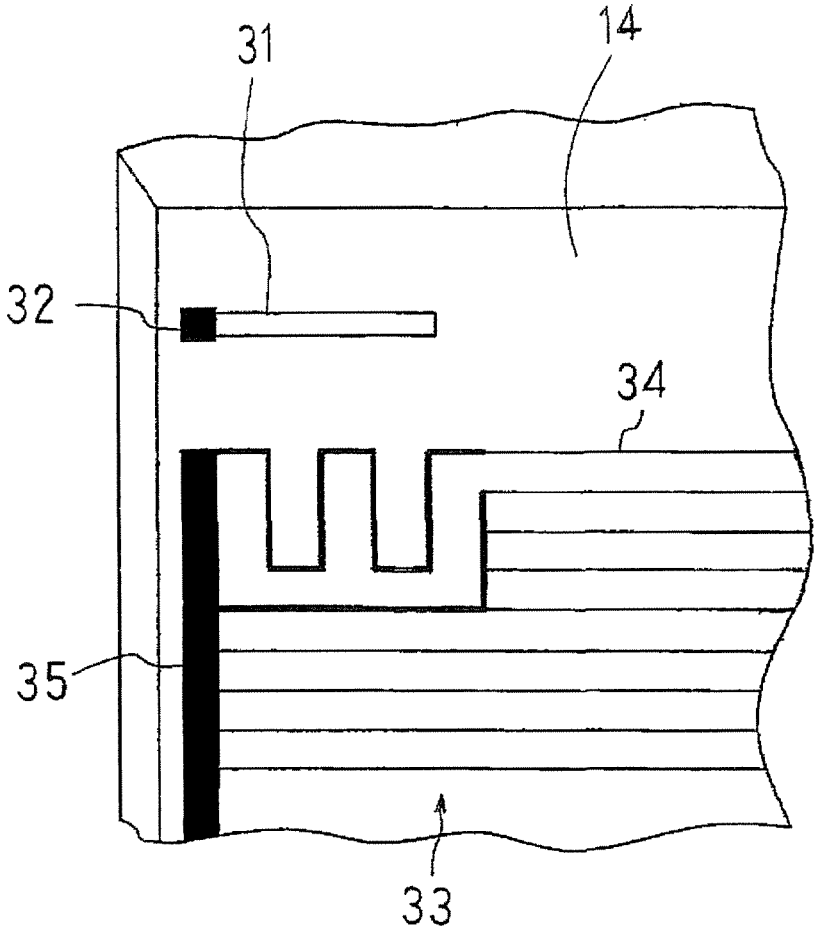
FIG. 2 is a plan view showing prior art.

Now, the high frequency wave glass antenna for an automobile according to the present invention will be described in detail based on preferred embodiments, which are shown in the accompanying drawings. FIG. 1 is a plan showing the high frequency wave glass antenna for an automobile according to an embodiment of the present invention, and FIG. 3 is a plan view showing the dimensional relationship of detours shown in FIG. 1.

Figure 3:
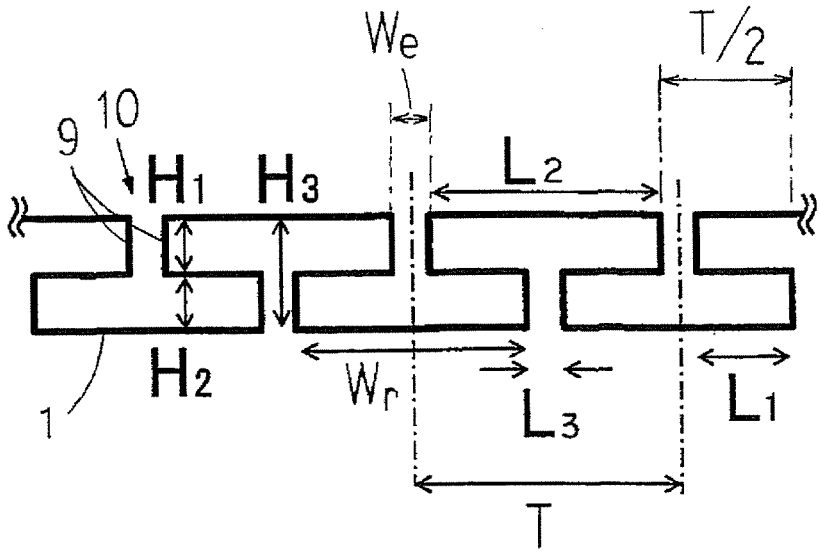
FIG. 3 is a plan view showing the dimensional relationship of detours shown in FIG. 1.

In FIGS. 1 and 3, reference symbol 1 designates a detour, reference symbol 2 designates heating wires, reference symbol 2*a* designates the heating wire at the highest position, reference symbol 2*b* designates the heating wire at the second highest position, reference symbol 2*c* designates the heating wire at the third highest position, reference symbol 5*a* designates a first bus bar, reference symbol 5*b* designates a second bus bar, reference symbol 6 designates a first antenna conductor, reference symbol 6*a* designates a power source of the first antenna conductor, reference symbol 7 designates a second antenna conductor, reference symbol 7*a* designates a power source of the second antenna conductor, reference symbol 9 designates a pair of connection lines, reference symbol 10 designates an inlet, reference symbol 14 designates a rear window glass sheet of an automobile, reference symbol 11 designates a first imaginary line, and reference symbol 12 designates a second imaginary line. In FIGS. 1 and 3, and figures showing the structures described later, the directions are referred to, based on the directions on these figures.

As shown in FIGS. 1 and 3, in the present invention, the rear window glass sheet 14 of the automobile includes the plural heating wires 2 and the plural bus bars 5*a* and 5*b* for feeding the plural heating wires 2.

The bus bar 5*a* is disposed on the right side of the rear window glass sheet 14, and the bus bar 5*b* is disposed on the left side of the rear window glass sheet 14. The bus bar 5*a* is disposed along a right edge of the rear window glass sheet 14, and the bus bar 5*b* is disposed along a left edge of the rear window glass sheet 14. The plural heating wires 2 and the plural bus bars 5*a* and 5*b* form a defogger. The plural heating wires 2 extend in a horizontal direction, in a substantially horizontal direction, in a direction along an upper edge of the rear window glass sheet 14 or in a direction along a lower edge of the rear window glass sheet 14

In the embodiment shown in FIG. 1, the first antenna conductor 6 is disposed on a right side of an upper margin of the rear window glass sheet 14 except for the defogger region, and the second antenna conductor 7 is disposed on a left side of the upper margin of the rear window glass sheet 14 except for the defogger region. However, the present invention is not limited to such a mode. The antenna conductors may be disposed anywhere in the upper margin of the rear window glass sheet 14 except for the defogger region. There is no limitation to the number of the antenna conductors disposed in the upper margin of the rear window glass sheet 14 except for the defogger region.

In the embodiment shown in FIG. 1, the heating wire 2*a* at the highest position has three detours 1 formed in a right portion thereof, and the heating wire 2*a* at the highest position has three detours 1 formed in a left portion thereof. In the same way, each of the heating wires 2*b* and 2*c* has six detours 1 formed therein. However, the present invention is not limited to such a mode. Each of the heating wires may have such a detour formed at one or more locations therein.

In the embodiment shown in FIG. 1, the detours 1 are formed in each of the heating wires 2*a*, 2*b* and 2*c*, which are preferred. However, the present invention is not limited to such a mode. The detours may be formed in a heating wire disposed in a different position. There is no limitation to the number of the heating wires with the detours formed therein.

It is preferred that the detours 1 be disposed in positions of the heating wires 2 under or substantially under the antenna conductors. The positions where the detours are formed will be described in more detail.

When it is assumed that there is a first straight line, which extends parallel to a plane parallel to a longitudinal direction of an automobile and a vertical direction, which has contact with, e.g., a right edge of the first antenna conductor 6, and which passes through at least one of the heating wires 2, the first straight line is called the first imaginary straight line 11. In addition, when it is assumed that there is a second straight line, which extends parallel to the plane parallel to the longitudinal direction of the automobile and the vertical direction, which has contact with, e.g., a left edge of the first antenna conductor 6, and which passes through at least one of the heating wires 2, the second straight line is called the second imaginary straight line 12.

In the embodiment shown in FIG. 1, the central detour 1 of a group of three detours 1 formed under the first conductor 6 is disposed between the first imaginary straight line 11 and the second imaginary straight line 12 as viewed three-dimensionally. The phrase "as viewed three-dimensionally" means to see from a direction vertical to a surface of the rear window glass sheet 14 in an area of the rear window glass sheet between the first imaginary straight line and the second imaginary straight line. Each of the detours 1 that are disposed on the left side and the right side of the above-mentioned central detour 1 is partly disposed between the first imaginary straight line 11 and the second imaginary straight line 12 as viewed three-dimensionally.

The positions where the detours 1 are disposed is not limited to the positions in the embodiment shown in FIG. 1. For example, when a single detour 1 is disposed under or substantially under the first antenna conductor 6, it is preferred that the detour 1 be partly or entirely disposed between the first imaginary straight line and the second imaginary straight line as viewed three-dimensionally. When plural detours 1 are disposed under or substantially under the first antenna conductor 6, it is preferred that at least one of the detours 1 be partly or entirely disposed between the first imaginary straight line and the second imaginary straight line as viewed three-dimensionally.

In the embodiment shown in FIGS. 1 and 3, each of the heating wires having the detours 1 formed therein has an inlet 10 connected to each of the detours 1, and both ends of each inlet are connected to both ends of the corresponding detour 1 by a pair of connections lines 9. The present invention is not limited to such a mode. Both ends of each inlet may be directly connected to both ends of the corresponding detour 1.

In a case where both ends of an inlet 10 are connected to both ends of the corresponding detour 1 by a pair of connection lines, a shorter spacing of the shortest spacing between the paired connection lines 9 and the shortest spacing between both ends of the inlet is called $W_e$, and in a case where both ends of the inlet 10 are directly connected to both ends of the corresponding detour 1, the shortest spacing between both ends of the inlet 10 is called $W_e$, when the maximum width of the detour 1 in a horizontal direction is called $W_r$, and when a received frequency has a wavelength of $\lambda_0$ in the air, the formula of $L_1 \geqq 0.0053 \cdot \lambda_0$ is established where the formula of $\{(W_r - W_e)/2\} = L_1$ is established.

When the formula of $L_1 \geqq 0.0053 \cdot \lambda_0$ is established, the antenna gain and the antifogging effect are improved in comparison with a case where $L_1$ is less than $0.0053 \cdot \lambda_0$. It is preferred from the viewpoint of further improving the antifogging effect that the formula of $(L_1/W_r) \geqq 0.02$ be established in addition to the condition just stated above. With respect to this range, a more preferred range is $(L_1/W_r) \geqq 0.03$, a particularly preferred range is $(L_1/W_r) \geqq 0.05$, and the most preferred value is 0.07.

It is preferred from the viewpoint of further improving the antifogging effect that the formula of $L_1 \geqq 3$ mm be established in addition to the conditions just stated above. With respect to this range, a more preferred range is $L_1 \geqq 5$ mm, and a particularly preferred range is $L_1 \geqq 10$ mm. It should be noted the formula of $W_r > W_e$ is established.

The present invention is classified, having not only different frequency-matching modes, depending on different frequencies in the frequency range of a received broadcast frequency band or on different bandwidths of the above-mentioned frequency range, but also different modes, depending on the size of a vertical width of a detour 1. Now, the respective modes will be described.

For describing several modes below, used words and the like will be explained. At least one of the plural heating wires has plural detours 1 formed therein, and the interval between the centers of adjacent detours or between the centers of gravity of adjacent detours, which is the period between adjacent detours 1, is called T.

On the premises stated above, it is assumed that the center frequency of a desired broadcast frequency band or the center frequency of a specific frequency band has a wavelength of $\lambda_c$ in the air, that the formula of $(W_r - 0.4\text{ mm})/2 = t_c$ is established, and that the formula of $(T - W_e - 0.4\text{ mm})/2 = t_d$ is established.

It should be noted that the minimum value of $W_e$ is normally limited to 0.4 mm in terms of production. It is preferred from the viewpoint of avoiding a short-circuit failure caused by metal migration that $W_e$ be 0.4 mm or above. For this reason, since the formula of $L_1 = (W_r - 0.4\text{ mm})/2$ is established when $W_e = 0.4$ mm is substituted in the formula of $L_1 = (W_r - W_e)/2$, $(W_r - 0.4\text{ mm})/2$ is replaced by $t_c$ for simplifying the related formulas explained below.

It should be also noted that the maximum value of $W_r$ is normally limited to (T−0.4 mm) in terms of production. It is preferred for the purpose of adjacent detours being short-circuited and broken down by metal migration that $W_r$ be (T−0.4 mm) or below. For this reason, since the formula of $L_1 = (T - W_e - 0.4\text{ mm})/2$ is established when the formula of $W_r = (T - 0.4\text{ mm})$ is substituted in the formula of $L_1 = (W_r - W_e)/2$, $(T - W_e - 0.4\text{ mm})/2$ is replaced by $t_d$ for simplifying the related formulas explained below.

A horizontal portion, a substantially horizontal portion, a portion extending in a direction along the upper edge of the rear window glass sheet or a portion extending in a direction along the lower edge of the rear window glass sheet in the entire portion of each of the plural heating wires except for the detours 1 and the paired connection lines 9 is called an original heating wire. For example, the heating wires 2*a*, 2*b* and 2*c* shown in FIG. 1 are not only heating wires but also original heating wires.

When paired connection lines 9 are disposed as shown in FIG. 3, the vertical width of the shape that is formed by a detour 1 and its corresponding paired connection lines 9 and extends in the vertical direction (the direction vertical to the corresponding original heating line) is called $H_3$. When no paired connection lines 9 are disposed, the vertical width of a detour, which is vertical to the corresponding original heating wire, is called $H_3$.

(1) General Mode

In a case where a received broadcast frequency band is within a range of 300 to 1,000 MHz and where a frequency band, which has the difference between the maximum frequency and the minimum frequency ranging from 91 to 169 MHz, is called a specific frequency band, when the above-mentioned broadcast frequency band contains the specific frequency band, or when the above-mentioned broadcast frequency band accords with the specific frequency band, the general mode is a mode that receives at least one of the frequencies existing in the specific frequency band.

The reason why the difference between the maximum frequency and the minimum frequency is determined to preferably range from 91 to 169 MHz is that since the difference between the maximum frequency and the minimum frequency is 130 MHz with respect to 470 to 600 MHz containing the current digital television broadcasts in the digital terrestrial television broadcast band in Japan, the range of 91 to 169 MHz is selected in consideration of upper and lower allowable tolerances of 30% centering around 130 MHz. In this mode, the difference between the maximum frequency and the minimum frequency in the specific frequency band ranges as shown in Table 2.

When a desired broadcast frequency band is in the specific frequency band, and when the center frequency of the specific frequency band has a wavelength of $\lambda_c$ in the air, it is preferred from the viewpoint of improving the antenna gain that $H_3$ be within the range of $0.022\lambda_c \leqq H_3 \leqq 0.186\lambda_c$. $H_3$ is more preferably within the range of $0.022\lambda_c \leqq H_3 \leqq 0.134\lambda_c$.

In the range of $0.022\lambda_c \leqq H_3 \leqq 0.134\lambda_c$, $L_1$ ranges as shown in Table 1. When $L_1$ is within one of these ranges, the antenna gain is normally improved, which is preferred. However, $L_1$ is not within one of these ranges, the antenna gain is improved in some cases. $H_3$ ranges as shown in Table 3. The antenna gain is improved according to an increase in the numerical sequence in Table 3.

With respect to the phrase "X is $-(14/25)\cdot H_3+0.096\lambda_c$" shown in Table 1, the maximum value of $L_1$ is about 40 mm in FIG. 10 ($H_3$=25 mm) stated later, and the maximum value of $L_1$ at a directional antenna gain of −4 dB (a substantially preferred range) is about 26 mm in FIG. 11 ($H_3$=50 mm) stated below. That phrase is based on the formula of $L_1=-(14/25)\cdot H_3+54$ mm, which is obtained by plotting these two points in a plane of coordinates representing $L_1$ as the vertical axis and $H_3$ as the horizontal axis. It should be noted that when 54 mm is divided by the wavelength $\lambda_c$ (560.75 mm) in the air at the center frequency (535 MHz) of 470 to 600 MHz containing the current digital television broadcasts and is standardized, the value of $0.096\lambda_c$ is obtained.

When plural detours 1 are formed, it is preferred from the viewpoint of improving the antenna gain that T as the period between adjacent detours 1 be $0.257\lambda_c$ or below, in particular $0.235\lambda_c$ or below. With respect to the calculated values in the examples stated below, the antenna gain is improved when the period T is 120 mm or below (65 mm, 80 mm and 120 mm) (see FIG. 10), and determination has been made in consideration of an allowable tolerance of 120 mm.

When the shortest spacing between adjacent detours is called $L_3$, the formula of $L_3=T-W_r$ is established. It is preferred from the viewpoint of improving the antenna gain that $L_3$ and $W_e$ satisfy the formula of $0.8\cdot L_3 \leqq W_e \leqq 1.2\cdot L_3$, in particular the formula of $0.9L_3 \leqq W_e \leqq 1.1\cdot L_3$. With respect to the calculated values in the examples stated below, the antenna gain is improved at the formula of $L_3=W_e$ is established (FIG. 10), and determination has been made in consideration of this allowable tolerance.

Since the formula of $T=2*L_1+W_e+L_3$ is established, the formula of $W_e \geqq 0.4$ mm is established, the formula of $L_3 \geqq 0.4$ mm is established and the formula of $L_1 \geqq 3$ mm is established as stated above, the formula of $T \geqq 6.8$ mm is established. When T is standardized by $\lambda_c$=560.75 mm, the formula of $T \geqq 0.012$ is established.

TABLE 1

| | Ranges of $L_1$ |
|---|---|
| Preferred range | $0.0089\ \lambda_c$ to X |
| More preferred range | $0.018\ \lambda_c$ to X |
| Particularly preferred range | $0.027\ \lambda_c$ to X |
| Most preferred range | $0.039\ \lambda_c$ to X (in the range of $0.022\ \lambda_c \leqq H_3 \leqq 0.067\ \lambda_c$) |
| Explanation of X | X is the shortest one among "$-(14/25)\cdot H_3 + 0.096\ \lambda_c$", $t_c$ and $t_d$. |

TABLE 2

| Ranges of difference between maximum frequency and minimum frequency in specific frequency band | |
|---|---|
| Preferred range | 91 to 169 <Hz |
| More preferred range | 104 to 156 MHz |
| Particularly preferred range | 117 to 143 MHz |
| Most preferred range | 123.5 to 136.5 MHz |

TABLE 3

| Numerical sequence in range of value of $H_3$ | General mode | Digital terrestrial television broadcast matching mode (mm) |
|---|---|---|
| 1 | $0.022\ \lambda_c \leqq H_3 \leqq 0.186\ \lambda_c$ | $12.5\text{ mm} \leqq H_3 \leqq 105\text{ mm}$ |
| 2 | $0.022\ \lambda_c \leqq H_3 \leqq 0.134\ \lambda_c$ | $12.5 \leqq H_3 \leqq 75$ |
| 3 | $0.031\ \lambda_c \leqq H_3 \leqq 0.116\ \lambda_c$ | $17.5 \leqq H_3 \leqq 65$ |
| 4 | $0.036\ \lambda_c \leqq H_3 \leqq 0.107\ \lambda_c$ | $20 \leqq H_3 \leqq 60$ |
| 5 | $0.040\ \lambda_c \leqq H_3 \leqq 0.098\ \lambda_c$ | $22.5 \leqq H_3 \leqq 55$ |

Figure 16:
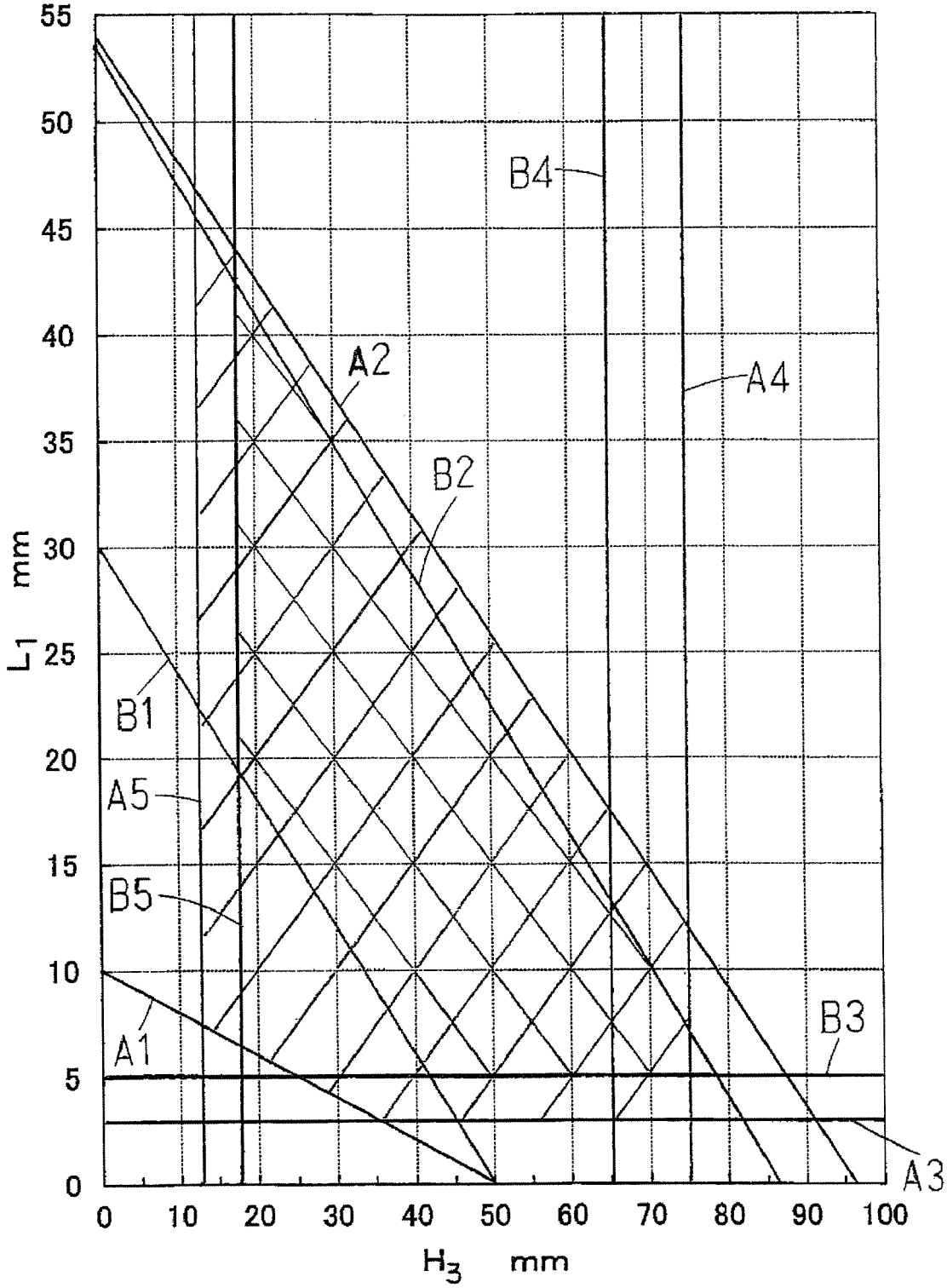
FIG. 16 is a plane of coordinates, whose vertical axis and horizontal axis represent $L_1$ and $H_3$ with respect to the relationship between $L_1$ and $H_3$.

With respect to the relationship between $L_1$ and $H_3$, it is preferred from the viewpoint of improving the antenna gain that $L_1$ and $H_3$ exist in the range surrounded by a straight line $A_\lambda$1, a straight line $A_\lambda$2, a straight line $A_\lambda$3, a straight line $A_\lambda$4 and a straight line $A_\lambda$5 listed below in a plane of coordinates representing $L_1$ as the vertical axis and $H_3$ as the horizontal axis as shown in FIG. 16 stated below.

| | |
|---|---|
| $L_1 = -0.2\cdot H_3 + 0.018\ \lambda_c$ | straight line $A_\lambda 1$ |
| $L_1 = -(14/25)\cdot H_3 + 0.096\ \lambda_c$ | straight line $A_\lambda 2$ |
| $L_1 = 0.0053\cdot \lambda_c$ | straight line $A_\lambda 3$ |
| $H_3 = 0.134\cdot \lambda_c$ | straight line $A_\lambda 4$ |
| $H_3 = 0.022\cdot \lambda_c$ | straight line $A_\lambda 5$ |

For the same reason, it is preferred that $L_1$ and $H_3$ exist in the range surrounded by a straight line $B_\lambda$1, a straight line $B_\lambda$2, a straight line $B_\lambda$3, a straight line $B_\lambda$4 and a straight line $B_\lambda$5 listed below.

| | |
|---|---|
| $L_1 = -0.6 \cdot H_3 + 0.053\ \lambda_c$ | straight line $B_\lambda 1$ |
| $L_1 = -(15.5/25) \cdot H_3 + 0.095\ \lambda_c$ | straight line $B_\lambda 2$ |
| $L_1 = 0.0089 \cdot \lambda_c$ | straight line $B_\lambda 3$ |
| $H_3 = 0.116 \cdot \lambda_c$ | straight line $B_\lambda 4$ |
| $H_3 = 0.031 \cdot \lambda_c$ | straight line $B_\lambda 5$ |

It should be noted that the straight lines $A_\lambda$1 to $A_\lambda$5 and the straight lines $B_\lambda$1 to $B_\lambda$5 are straight lines that are obtained by respectively standardizing the straight lines A1 to A5 and the straight lines B1 to B5 shown in FIG. 16 by $\lambda_c$.

(2) Digital Terrestrial Television Broadcast Matching Mode

The digital terrestrial television broadcast matching mode is a mode for receiving at least one frequency of 470 to 600 MHz, wherein a received broadcast frequency band is contained in the digital terrestrial television broadcast band in Japan (470 to 770 MHz).

In the digital terrestrial television broadcast matching mode, it is preferred from the viewpoint of improving the antenna gain that $H_3$ be within a range of 12.5 mm$\leqq H_3 \leqq$105 mm. $H_3$ is more preferably within a range of 12.5 mm$\leqq H_3 \leqq$75.0 mm. The range of 12.5 mm$\leqq H_3 \leqq$105 mm is determined as a preferred range in consideration of an allowable tolerance since $H_3$ is from 15 mm to 70 mm in the calculated values in the Examples stated below.

When $H_3$ is within the range of 12.5 mm$\leqq H_3 \leqq$75.0 mm, $L_1$ ranges as shown in Table 4. When $L_1$ is within one of these ranges, the antenna gain is normally improved. In this mode, the antenna gain is improved mainly for 470 to 600 MHz.

In a case where plural detours 1 are formed, when the spacing between the centers or the centers of gravity of adjacent detours as the period between the adjacent detours is T, it is preferred that the period T be 144 mm or below, in particular 132 mm or below. When the period T is 120 mm or below (65 mm, 80 mm and 120 mm) in the calculated values in the Examples stated below, the antenna gain is improved (FIG. 10), and determination has been made in consideration with an allowance tolerance of 120 mm.

When the shortest spacing between adjacent detours is $L_3$, the formula of $L_3 = T - W_r$ is established. It is preferred from the viewpoint of improving the antenna gain that $L_3$ and $W_e$ satisfy the formula of $0.8 \cdot L_3 \leqq W_e \leqq 1.2 \cdot L_3$, in particular the formula of $0.9 \cdot L_3 \leqq W_e \leqq 1.1 \cdot L_3$. The antenna gain is improved when the formula of $L_3 = W_e$ is established in the calculated values in the Examples stated below (FIG. 10), and determination has been made in consideration of this allowable tolerance.

TABLE 4

| | Ranges of $L_1$ |
|---|---|
| Preferred range | 5 to X |
| More preferred range | 10 to X |
| Particularly preferred range | 15 to X |
| Most preferred range | 22 to X (in the range of 12.5 mm $\leqq H_3 \leqq$ 37.5 mm) |
| Explanation of X | X is the shortest one among "$-(14/25) \cdot H_3 + 54$ mm", $t_c$ and $t_d$. |

With respect to the relationship between $L_1$ and $H_3$, it is preferred from the viewpoint of improving the antenna gain that $L_1$ and $H_3$ exist in the range surrounded by a straight line A1, a straight line A2, a straight line A3, a straight line A4 and a straight line A5 listed below in a plane of coordinates representing $L_1$ as the vertical axis and $H_3$ as the horizontal axis as shown in FIG. 16 stated below.

| | |
|---|---|
| $L_1 = -0.2 \cdot H_3 + 10$ mm | straight line A1 |
| $L_1 = -(14/25) \cdot H_3 + 54$ mm | straight line A2 |
| $L_1 = 3$ mm | straight line A3 |
| $H_3 = 75$ mm | straight line A4 |
| $H_3 = 12.5$ mm | straight line A5 |

For the same reason, it is preferred that $L_1$ and $H_3$ exist within the range surrounded by a straight line B1, a straight line B2, a straight line B3, a straight line B4 and a straight line B5 listed below.

| | |
|---|---|
| $L_1 = -0.6 \cdot H_3 + 30$ mm | straight line B1 |
| $L_1 = -(15.5/25) \cdot H_3 + 53.5$ mm | straight line B2 |
| $L_1 = 5$ mm | straight line B3 |
| $H_3 = 65$ mm | straight line B4 |
| $H_3 = 17.5$ mm | straight line B5 |

The shape of the detours 1 according to the present invention will be described.

In the embodiment shown in FIG. 1, each of the detours 1 is formed in such a semi-loop shape that a discontinuity is formed in a portion of a loop shape, and that both ends of each of the detours are both ends of the corresponding discontinuity.

Each of the detours is not limited to be formed in the shape shown in FIG. 1. Each of the detours may be formed in any one of the shapes described below. It should be noted that the shapes described below may contain the shape shown in FIG. 1 in some cases in terms of expression.

Each of the detours may be formed in such a shape as to have a cut-out portion like something that has a portion of a polygonal shape or substantially polygonal shape cut out therein, wherein both ends of each of the detours are both ends of the cut-out portion. An example of this shape includes a mode wherein one side of the above-mentioned polygonal shape or substantially polygonal shape is lacking (for example, FIG. 6). Another example includes a mode wherein the above-mentioned polygonal shape or substantially polygonal shape is a square shape or substantially square shape. When each of the detours is formed in a square shape or substantially square shape, it is preferred from an aesthetic standpoint and in terms of space saving that the side opposite a side with a discontinuity being formed therein extends horizontally or substantially horizontally. It is meant that the cut-out portion has a longer length than the discontinuity.

Figure 4:
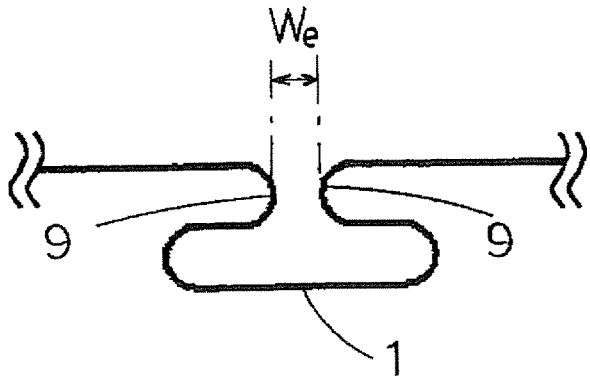
FIG. 4 is a plan view showing a detour and its peripheral portion according to a different mode from those shown in FIGS. 1 and 3.

Each of the detours 1 may be formed in such a C-character shape or substantially C-character shape that both ends of each of the detours 1 are both ends of the C-character shape or substantially C-character shape (FIG. 4).

When each of the detours 1 is formed in such a shape as to have branch lines connected to both ends of a U-character shape, substantially U-character shape, C-character shape or substantially C-character shape, and when these two lines are called a first branch line and a second branch line, each of the detours may be formed in such a shape that the first branch line and the second branch line extend in such directions as to be brought close to each other, that an end of the first branch line close to the second branch line and an end of the second branch line close to the first branch line are respectively both ends of each of the detours. It is preferred that the first branch line and the second branch line be parallel or substantially parallel to the corresponding original heating wire and horizontal or substantially horizontal.

Each of the detours 1 may be formed in such a shape as to have a cut-out portion like something that has a portion of the arc of a circular shape, substantially circular shape, oval shape or substantially oval shape cut out therein, wherein both ends of the cut-out portion are both ends of each of the detours 1. When each of the detours 1 may be formed in such a shape as to have a cut-out portion like something that has a portion of the arc of an oval shape or substantially oval shape cut out therein, it is preferred from an aesthetic standpoint and in terms of space-saving to adopt such a shape that an intersection of the minor axis of the oval shape or substantially oval shape and the arc of the oval shape or substantially oval shape is contained in the cut-out portion.

Figure 5:
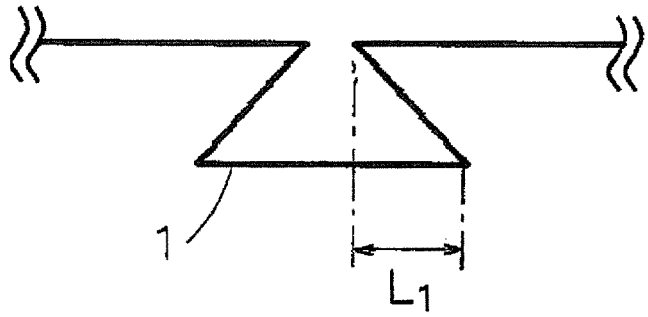
FIG. 5 is a plan view showing a detour and its peripheral portion according to a different mode from those shown in FIGS. 1 and 3.

Each of the detours 1 may be formed in such a shape as to have a cut-out portion like something that has a portion containing an apex of a triangular shape or substantially triangular shape, cut out therein, wherein both ends of each of the detours 1 are both ends of the cut-out portion (FIG. 5). In this case, it is preferred from an aesthetic standpoint and in terms of space-saving that the side opposite the apex be horizontal or substantially horizontal.

Figure 6:
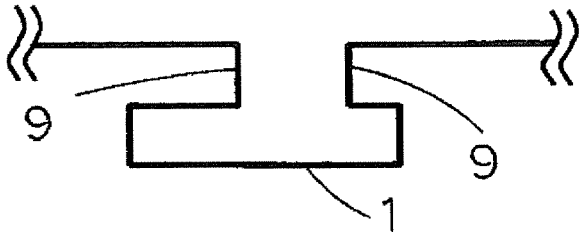
FIG. 6 is a plan view showing a detour and its peripheral portion according to a different mode from those shown in FIGS. 1 and 3.

It is preferred from the viewpoint of improving the antenna gain that each of the detours 1 be formed so as to be axisymmetrical about the center thereof in a left-to-right direction as the symmetrical axis. However, the present invention is not limited to this mode. The present invention is operable even if each of the detours is not so as to be axisymmetrical (FIG. 6). Even if each of the detours 1 is not so as to be axisymmetrical about the center thereof in the left-to-right direction as the symmetrical axis, it is preferred that the formula of $\{(W_r-W_e)/2\}=L_1$ be established.

Figure 7:
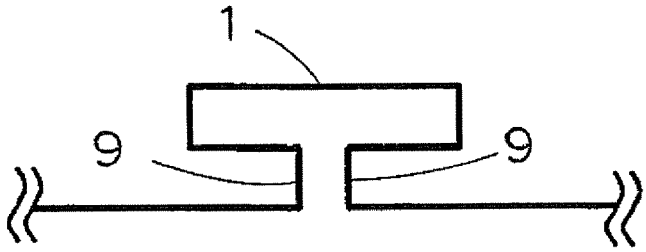
FIG. 7 is a plan view showing a detour and its peripheral portion according to a different mode from those shown in FIGS. 1 and 3.
Figure 8:
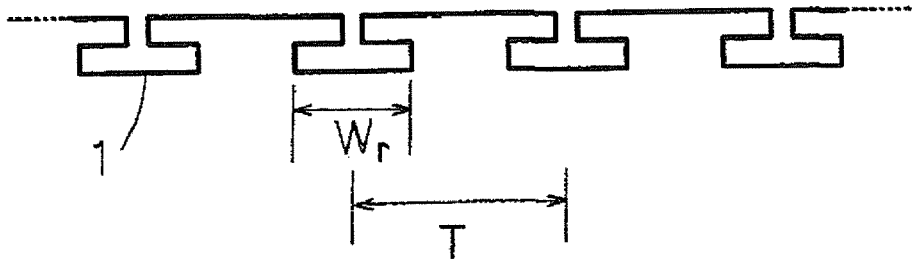
FIG. 8 is a plan view showing detours and their peripheral portions according to a different mode from those shown in FIGS. 1 and 3.

In the embodiment shown in FIGS. 1 and 3, each of the detours 1 is disposed at a lower position than the corresponding original heating wire, which is preferred from the viewpoint of improving the antenna gain since the antenna conductors 6 and 7 are apart from each of the detours 1. However, the present invention is not limited to this mode. The present invention is operable even if each of the detours 1 is disposed at a higher position than the corresponding original heating wire (FIG. 7). The present invention is operable even if the period T is much longer than the maximum width $W_r$ of each of the detours 1 (FIG. 8).

In a case where in the present invention, the spacing between the horizontal or substantially horizontal portions of adjacent heating wires except for the detours 1 and the paired connection lines 9 is called a original heating wire spacing, when no pair of connection lines 9 is disposed in connection with each of the detours, and when both ends of each of the inlets 10 are respectively connected directly to both ends of each of the detours 1, it is preferred that the vertical width of each of the detours 1 (the vertical width in a direction vertical to the corresponding original heating wire) be shorter than the original heating wire spacing. The reason is that the original heating wires are kept linear or substantially linear to secure a visual field.

When a pair of connection lines 9 is disposed in connection with each of the detours, and when both ends of each of the inlets 10 are respectively connected to both ends of each of the detours 1 through the paired connection lines, it is preferred that the vertical width of the shape formed by each of the detours and the corresponding paired connection lines (the vertical width in a direction vertical to the corresponding original heating wire) be shorter than the original heating wire spacing. The reason is that the original heating wires are kept linear or substantially linear to secure a visual field.

It is preferred that the original heater wire spacing be 15 to 60 mm. When the original heater wire spacing is 15 mm or above, the visual field of the rear window glass sheet 14 can be preferably better than a case where the distance between adjacent original heating wires is less than 15 mm. When the distance between adjacent original heating wires is 60 mm or below, the antifogging effect can be preferably improved in comparison with a case where the distance between adjacent original heating wires is longer than 60 mm. The distance between adjacent original heating wires more preferably ranges from 20 to 50 mm, particularly preferably ranges 25 to 40 mm and most preferably ranges 25 to 35 mm. For a same reason, it is preferred that the shortest spacing between the highest portion of a first joining heating wire 53 and a second joining heating wire 54 be 50 to 120 mm in the embodiment shown in FIG. 17 stated later.

It is preferred from the viewpoint improving the antenna gain and the F/B ratio that the shortest spacing between an antenna conductor and the original heating wire 2*a* at the highest position, or the shortest spacing between an antenna conductor and the highest portion of each of the detours 1 be 30 mm or above, in particular 40 mm or above. It is preferred in terms of space-saving that the shortest spacing between an antenna conductor and the original heating wire 1 at highest position be 200 mm or below, in particular 100 mm or below.

Figure 9:
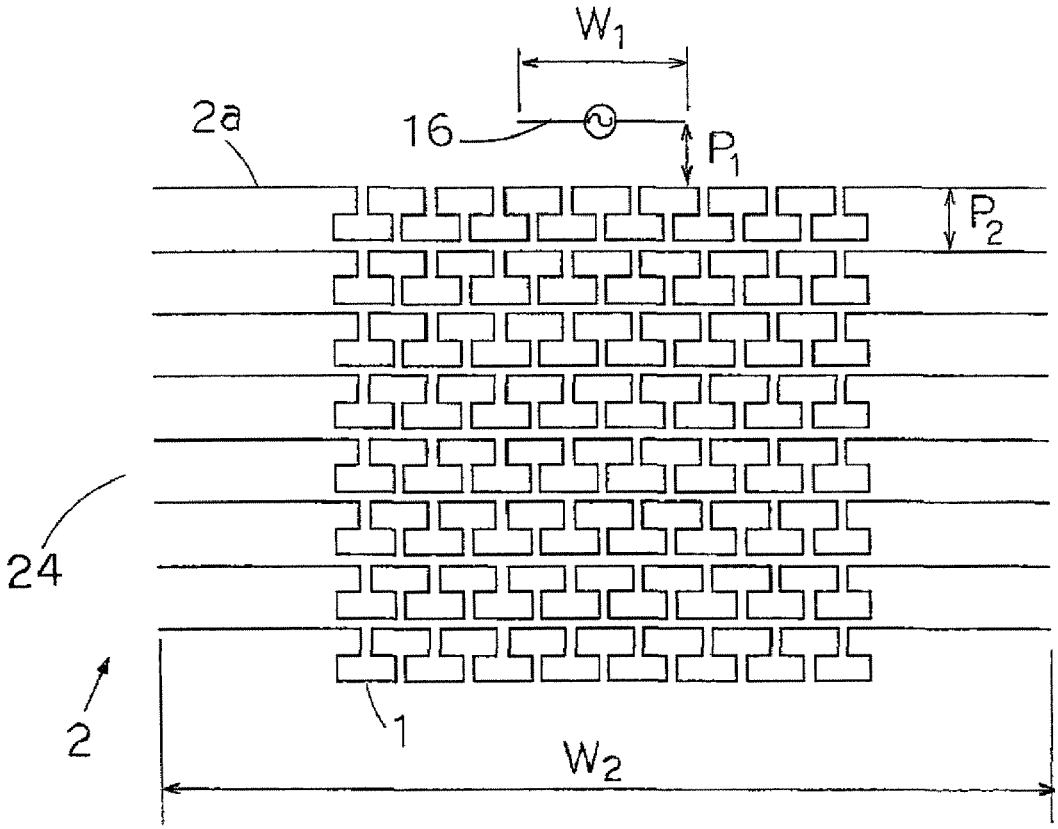
FIG. 9 is a plan view showing heating wires and an antenna conductor disposed on a glass substrate in Example 1.
Figure 15:
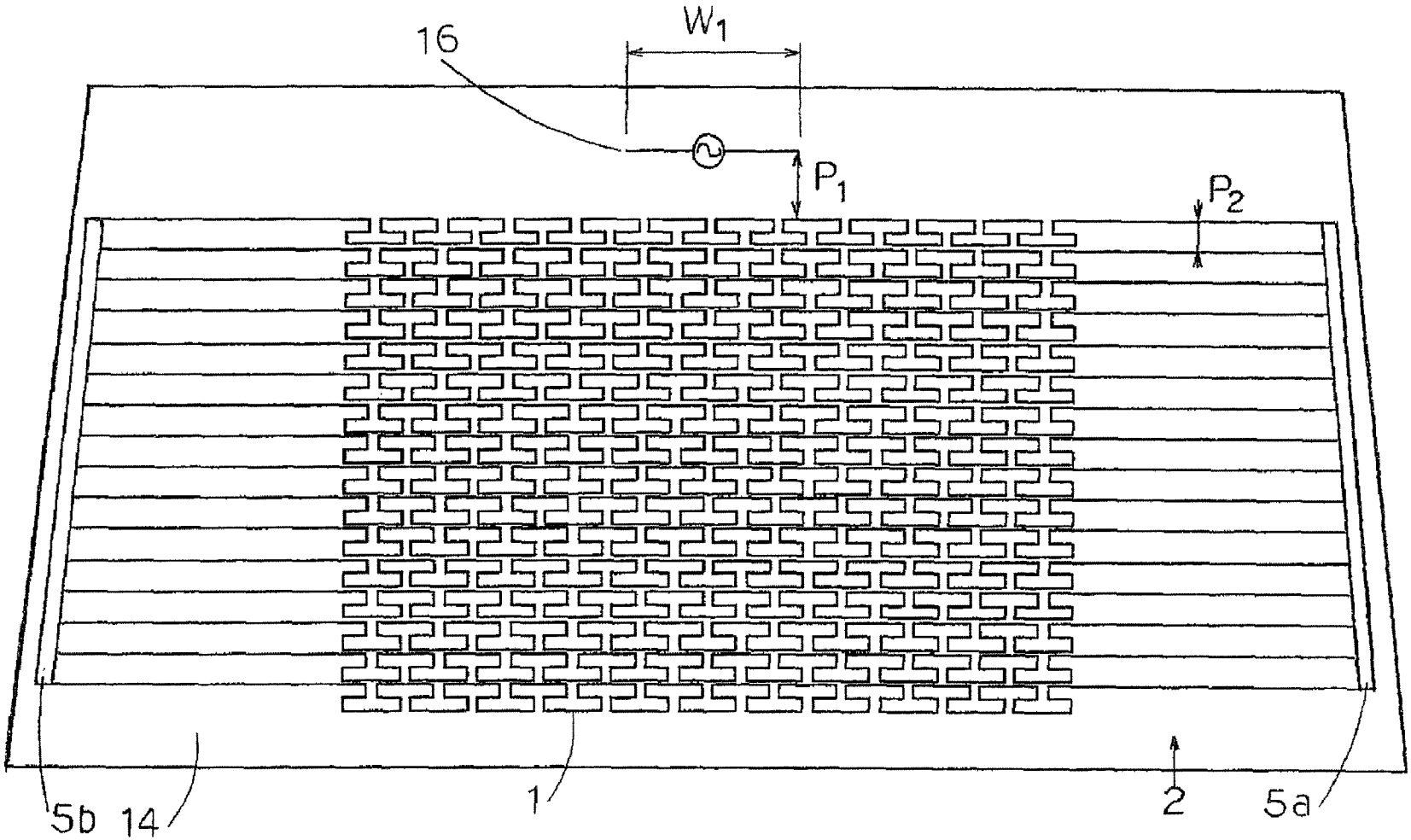
FIG. 15 is a plan view showing a rear window glass sheet having Sample 8-1 or 8-2.
Figure 17:
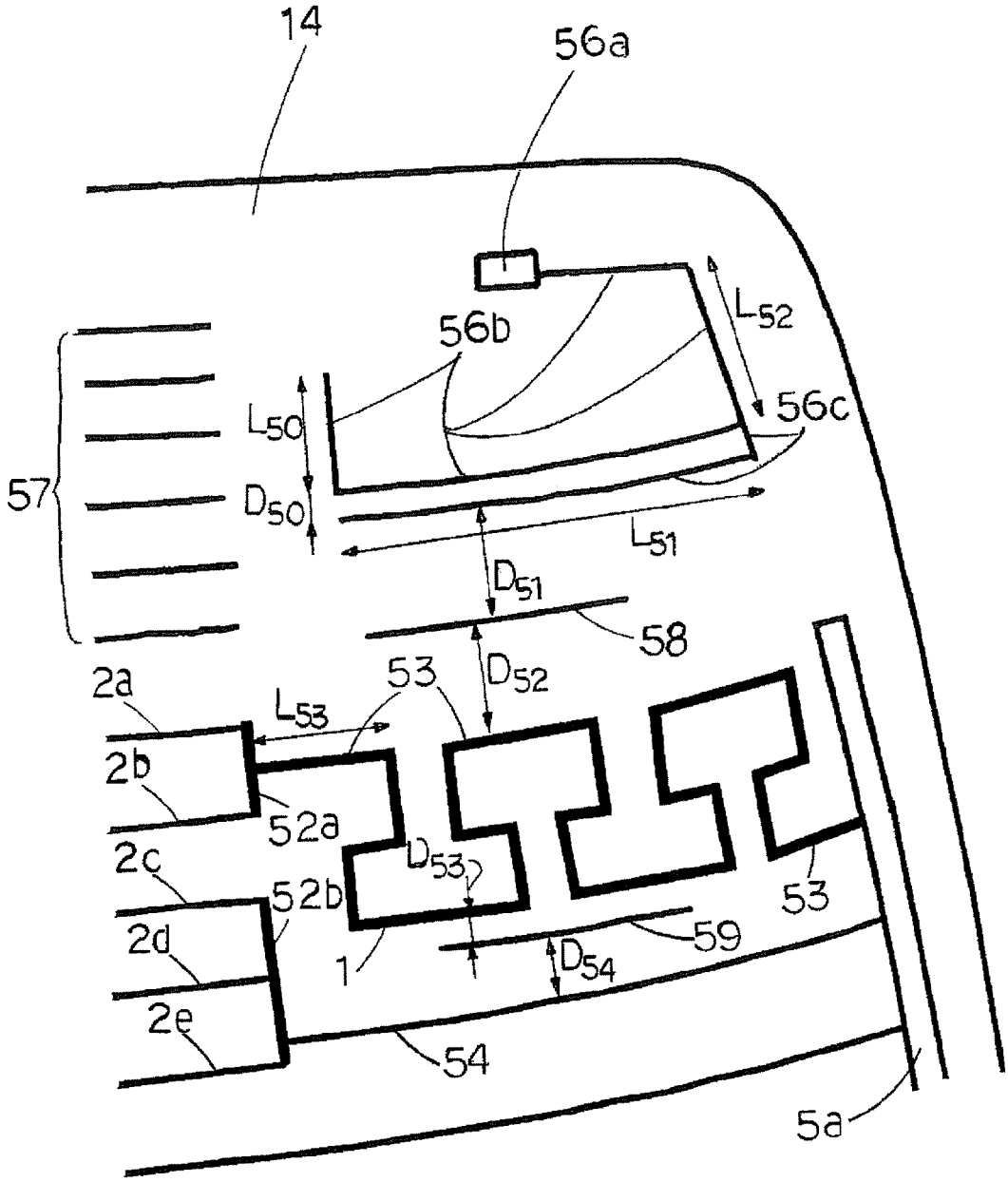
FIG. 17 is a plan view showing a different embodiment from the ones shown in FIGS. 1, 9 and 15.

FIG. 17 (seen from a car-interior-side or a car-exterior-side) shows a different embodiment from FIGS. 1, 9 and 15. In FIG. 17, reference symbol 2*d* designates a fourth heating wire, reference symbol 2*e* designates a fifth heating wire, reference symbol 52*a* designates a first short-circuit heating wire, reference symbol 52*b* designates a second short-circuiting heating wire, reference symbol 53 designates a first joining heating wire, reference symbol 54 designates a second joining heating wire, reference symbol 56*a* designates a feed point, reference symbol 56*b* designates a first antenna element, reference symbol 56*c* designates a second antenna element, reference symbol 57 designates an antenna conductor for receiving an AM broadcast band, which is not directly relevant to the present invention, reference symbol 58 designates a first island-shaped conductor, reference symbol 59 designates a second island-shaped conductor, reference symbols $L_{50}$, $L_{51}$, $L_{52}$ and $L_{53}$ designate lengths, respectively, and reference symbols $D_{50}$, $D_{51}$, $D_{52}$, $D_{53}$ and $D_{54}$ designate spacings, respectively. It should be noted that the first joining heating wire 53, the second joining heating wire 54, the first short-circuit heating wire 52*a* and the second short-circuit heating wire 52*b* are also constituent parts of the defogger. Each of the joining heating wires 53 and 54 is a kind of the corresponding original heating wire. The antenna conductor shown in FIG. 17 comprises the first antenna element 56*b* and the second antenna element 56*c*. However, the present invention is not limited to this mode. The antenna conductor may be formed in a different shape.

In the embodiment shown in FIG. 17, a highest heating wire 2*a* and a second highest heating wire 2*b* just under the highest heating wire 2*a*, which are disposed in a central portion of the rear window glass sheet 14 in the left-to-right direction, have leading edges connected by the first short-circuit heating wire 52*a* without reaching a bus bar 5*a*, and the first short-circuit heating wire 52*a* is connected to the first joining heating wire 53. This arrangement is preferred from the viewpoint of preventing the first joining heating wire 53 from being too thick. However, the present invention is not limited to this mode. The present invention is operable even if the highest heating wire 2*a*, the second highest heating wire 2*b* and the third highest heating wire 2*c* have leading edges connected by the first short-circuit heating wire 52*a* without reaching the bus bar 5*a*. The first joining heating wire 53 extends toward the bus bar 5*a*, beginning at the first short-circuit heating wire 52*a*, and the first joining heating wire reaches and is connected to the bus bar 5*a*.

In the embodiment shown in FIG. 17, the third heating wire 2*c*, the fourth heating wire 2*d* and the fifth heating wire 2*e* are connected together by the second short-circuit heating wire 52*b*, and the second short-circuit heating wire 52*b* is connected to the second joining heating wire 54. The second joining heating wire 54 extends toward the bus bar 5*a*, beginning at the second short-circuit heating wire 52*b*, and the second joining heating wire reaches and is connected to the bus bar 5*a*. The first joining heating wire 53 has two detours 1 formed therein. However, the present invention is not limited to this mode. The first joining heating wire may have a single detour 1 or more than two detours 1 formed therein.

In the embodiment shown in FIG. 17, the first island-shaped conductor 58 is disposed between the antenna conductor and the detours 1. In other words, the first island-shaped conductor 58 is disposed between the antenna conductor and the defogger. Further, the second island-shaped conductor 59 is disposed just under the detours 1. Each of the island-shaped conductors 58 and 59 shown in FIG. 17 is formed in a linear shape or substantially linear shape. It is preferred from the viewpoint of securing a good visual field that each of the island-shaped conductors be formed in such a shape. However, the present invention is not limited to this mode. Each of the island-shaped conductors 58 and 59 may be formed in such a shape to have any one of the conductors formed as shown in FIGS. 18 to 24.

Figure 18:
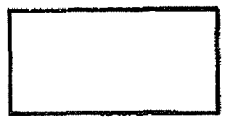
FIG. 18 is a plan view showing a different shape of the island-shaped conductors from that shown in FIG. 17.
Figure 19:
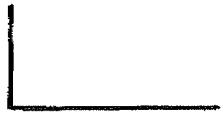
FIG. 19 is a plan view showing a different shape of the island-shaped conductors from that shown in FIG. 17.
Figure 20:
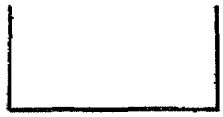
FIG. 20 is a plan view showing a different shape of the island-shaped conductors from that shown in FIG. 17.
Figure 21:
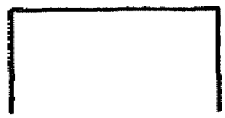
FIG. 21 is a plan view showing a different shape of the island-shaped conductors from that shown in FIG. 17.
Figure 22:
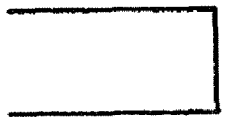
FIG. 22 is a plan view showing a different shape of the island-shaped conductors from that shown in FIG. 17.
Figure 23:
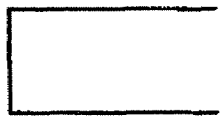
FIG. 23 is a plan view showing a different shape of the island-shaped conductors from that shown in FIG. 17.
Figure 24:
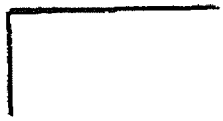
FIG. 24 is a plan view showing a different shape of the island-shaped conductors from that shown in FIG. 17.

FIG. 18 shows an example of each of the island-shaped conductors 58 and 59, which are formed in a square-loop shape or substantially square-loop shape. FIG. 19 shows an example of each of the island-shaped conductors 58 and 59, which are formed in an L-character shape or substantially L-character shape. It should be noted that each of the island-shaped conductors 58 and 59 may be formed in a left-right reversed L character shape or left-right reversed substantially L character shape, which is seen from the backside of the sheet showing FIG. 19. FIG. 20 shows an example of each of the island-shaped conductors 58 and 59, which are formed in a U-character shape or substantially U-character shape. FIG. 21 shows an example of each of the island-shaped conductors 58 and 59, which are formed in an upside-down U-character shape or upside-down substantially U-character shape. FIG. 22 shows an example of each of the island-shaped conductors 58 and 59, which are formed in a lying U-shape or lying substantially U-shape. FIG. 23 shows an example of each of the island-shaped conductors 58 and 59, which are formed in a left-right reversed, lying U-shape or left-right reversed, lying, substantially U-shape. FIG. 24 shows an example of the island-shaped conductors 58 and 59, which are formed in an upside-down L-shape or upside-down, substantially L-shape. It should be noted that each of the island-shaped conductors 58 and 59 may be formed in a left-right reversed, upside-down L-shape or left-right reversed, upside-down substantially L-shape.

When receiving a digital terrestrial television broadcast or a frequency band close thereto, it is preferred from the viewpoint of improving the antenna gain that the maximum width of each of the island-shaped conductors 58 and 59 in a horizontal direction be 30 to 150 mm.

It is preferred from the viewpoint of improving the antenna gain in that the shortest spacing $D_{51}$ between the antenna conductor and the first island-shaped conductor 58 be 1 to 100 mm. It is preferred from the viewpoint of improving the antenna gain in that the shortest spacing $D_{52}$ between the first joining heating wire 53 and the first island-shaped conductor 58 (the shortest spacing between the defogger and the first island-shaped conductor 58) be 5 to 50 mm.

In the present invention, it is preferred that the antenna conductors, such as the first antenna conductor 6 and the second antenna conductor 7, be used for a digital terrestrial television broadcast (in Japan), a US digital television broadcast, a Chinese digital television broadcast and a European digital television broadcast.

When receiving such a digital terrestrial television broadcast (in Japan), it is preferred that the radio wave received by each of the antenna conductors, such as the first antenna conductor 6 and the second antenna conductor 7, contain a frequency existing from 470 to 770 MHz.

When receiving the currently utilized frequency band for the digital terrestrial television broadcast (in Japan) (470 to 600 MHz), it is preferred that the radio wave received by each of the antenna conductors, such as the first antenna conductor 6 and the second antenna conductor 7, contain a frequency existing from 470 to 600 MHz.

When receiving a US digital television broadcast, it is preferred that a received radio wave contain a frequency existing from 698 to 806 MHz.

In the embodiment shown in FIG. 1, either one of the bus bars 5*a* and 5*b* is electrically connected to the positive electrode of a DC power source (not shown), and the remaining one of the bus bar is electrically connected to the negative electrode of the DC power source. In the embodiment shown in FIG. 1, the rear window glass sheet 14 includes the two bus bars 5*a* and 5*b*. However, the present invention is not limited to this mode. The rear window glass sheet may include more than two bus bars. In other words, the present invention is applicable as long as the defogger is configured so that a voltage is applied across two bus bars, which are close to the respective antenna conductors. The embodiment shown in FIG. 1 may be seen from the car-interior-side or the car-exterior-side.

In the present invention, it is preferred from the viewpoint of improving the antenna gain that the rear window glass sheet 14 be inclined at a angle of 18 to 36°, in particular 24 to 33° with respect to the horizontal direction.

In the present invention, each of the bus bars, the heating wires, the antenna conductors and the feed points is normally formed by printing paste containing conductive metal, such as silver paste, on the car-interior-side surface of the rear window glass sheet 14 and baking the printed paste. However, the present invention is not limited to this forming method. A linear member or foil member, which comprises a conductive substance, such as copper, may be formed on the car-interior-side surface or the car-exterior-side surface of the rear window glass sheet 14, or is disposed in the rear window glass sheet 14. A synthetic resin film, which has a conductive layer formed therein or thereon, may be disposed on the car-interior-side surface or the car-exterior-side surface of the rear window glass sheet 14, forming the antenna conductors.

In the present invention, a light-shielding layer may be disposed on the rear window glass sheet 14, and a portion or the entire portion of at least one of the antenna conductors and the defogger may be disposed on the light-shielding layer. An example of the light-shielding layer includes ceramics, such as a black ceramic layer. In this case, when the rear window glass sheet 14 is seen from the car-exterior-side, the antenna conductors and another element disposed on the shielding layer are shielded by the shielding layer. As a result, the rear window glass sheet 14 has such a superior design that the antenna device cannot be seen from the car-exterior-side.

In the embodiment shown in FIG. 1, each of the first antenna conductor 6 and the second antenna conductor 7 is a dipole antenna. However, the present invention is not limited to this mode. In the present invention, there is no limitation to the kind of the antennas. In other words, each of the first antenna conductor 6 and the second antenna conductor may be a monopole antenna, a single-pole antenna or a bipole antenna having a single feed point at respective portions and including a grounded conductor (not shown).

In the present invention, it is preferred that diversity reception be performed between the first antenna conductor 6 and the second antenna conductor 7. The reason is that the antenna performance is brought close to a non-directional property. There is no limitation to the number of antenna conductors disposed on the automobile in addition to the first antenna conductor 6 and the second antenna conductor 7. Diversity reception may be performed between a combination of the first antenna conductor 6 and the second antenna conductor 7 in the present invention, and another antenna, such as a pole antenna, and/or another glass antenna.

EXAMPLES

Although the present invention will be described in reference to Examples, it should be noted that the present invention is not limited to these Examples, and that various variations or modifications are included in the present invention as long as the variations and modifications do not depart from the spirit of the invention.

Now, the Examples will be described in detail, referring to the accompanying drawings.

Example 1 (Examples and Comparative Examples)

It is assumed that the rear window glass sheet comprises a glass substrate 24 as shown in FIG. 9 (see from the car-interior-side or the car-exterior-side) in each of the Examples and the Comparative Examples. It is also assumed that, in each of the Examples and the Comparative Examples, the heating wires 2 comprise eight conductors, which are disposed on the glass substrate 24 having the specifications stated below and are electrically insulated in FIG. 9. Antenna gains (directional gains) at the center of a rear portion of the automobile and in the horizontal direction are calculated according to the FDTD method (Finite Difference Time Domain method) in each of the Examples and the Comparative Examples. In each of the Examples and the Comparative Examples, it is assumed that the glass substrate 24 has an infinite size, and that the glass substrate 24 is inclined at an angle of 26° with respect to the horizontal direction. In each of the Examples and the Comparative Examples, it is assumed that the antenna conductor 16 comprises a dipole antenna and extends parallel to the original heating wires. In each of the Examples and the Comparative Examples, it is assumed that the heating wires 2 are formed so as to be axisymmetrical with respect to the center of the heating wires 2 in the left-to-right direction as the symmetrical axis.

| | |
|---|---|
| Thickness of glass substrate 24 | 3.5 mm |
| Dielectric constant of glass substrate 24 | 7.0 |
| Transverse width (horizontal width) $W_1$ of antenna conductor 16 | 160 mm |
| Transverse width (horizontal width) $W_2$ of heating wire 2 | infinite |
| Shortest spacing $P_1$ between antenna conductor 16 and highest heating wire | 64 mm |

-continued

| | |
|---|---|
| Conductor thickness of antenna conductor 16 and heating wire 2 | 0.01 mm |
| Conductor width of antenna conductor 16 | 0.4 mm |
| Conductor width of heating wire | 0.4 mm |

With respect to the spacing $P_2$ (equal spacings) between the horizontal portions (the original heating wires) of adjacent ones of the eight conductors (assumed as being the heating wires 2) except for each of the detours 1 and each pair of connection lines 9, Samples Nos. 1-1 to 3-5 are assumed as being set at 30 mm, and Samples Nos. 4-1 to 4-6 are assumed as being set at 60 mm.

With respect to Samples Nos. 1-1 to 4-6, it is assumed that each of the heating wires 2 has eight detours 8 formed therein. Samples Nos. 1-1, 2-1, 3-1 and 4-1 are comparative examples since the detours of each of the heating wires 2 and portions of each of the heating wires adjacent the detours 1 are formed in a meander shape because of having $L_1$ of 0.0 (zero) mm.

The dimensions of the respective samples are shown in Table 5 (unit: mm).

TABLE 5

| Sample No. | $L_1$ | $W_e$ | $L_3$ | $L_2$ | $W_r$ | T | $H_1$ | $H_2$ | $H_3$ |
|---|---|---|---|---|---|---|---|---|---|
| 1-1 | 0.0 | 32.5 | 32.5 | 32.5 | 32.5 | 65.0 | 12.5 | 12.5 | 25.0 |
| 1-2 | 7.5 | 25.0 | 25.0 | 40.0 | 40.0 | 65.0 | 12.5 | 12.5 | 25.0 |
| 1-3 | 12.5 | 20.0 | 20.0 | 45.0 | 45.0 | 65.0 | 12.5 | 12.5 | 25.0 |
| 1-4 | 17.5 | 15.0 | 15.0 | 50.0 | 50.0 | 65.0 | 12.5 | 12.5 | 25.0 |
| 1-5 | 22.5 | 10.0 | 10.0 | 55.0 | 55.0 | 65.0 | 12.5 | 12.5 | 25.0 |
| 1-6 | 27.5 | 5.0 | 5.0 | 60.0 | 60.0 | 65.0 | 12.5 | 12.5 | 25.0 |
| 2-1 | 0.0 | 40.0 | 40.0 | 40.0 | 40.0 | 80.0 | 12.5 | 12.5 | 25.0 |
| 2-2 | 10.0 | 30.0 | 30.0 | 50.0 | 50.0 | 80.0 | 12.5 | 12.5 | 25.0 |
| 2-3 | 20.0 | 20.0 | 20.0 | 60.0 | 60.0 | 80.0 | 12.5 | 12.5 | 25.0 |
| 2-4 | 30.0 | 10.0 | 10.0 | 70.0 | 70.0 | 80.0 | 12.5 | 12.5 | 25.0 |
| 3-1 | 0.0 | 60.0 | 60.0 | 60.0 | 60.0 | 120.0 | 12.5 | 12.5 | 25.0 |
| 3-2 | 10.0 | 50.0 | 50.0 | 70.0 | 70.0 | 120.0 | 12.5 | 12.5 | 25.0 |
| 3-3 | 20.0 | 40.0 | 40.0 | 80.0 | 80.0 | 120.0 | 12.5 | 12.5 | 25.0 |
| 3-4 | 30.0 | 30.0 | 30.0 | 90.0 | 90.0 | 120.0 | 12.5 | 12.5 | 25.0 |
| 3-5 | 40.0 | 20.0 | 20.0 | 100.0 | 100.0 | 120.0 | 12.5 | 12.5 | 25.0 |
| 4-1 | 0.0 | 32.5 | 32.5 | 32.5 | 32.5 | 65.0 | 25.0 | 25.0 | 50.0 |
| 4-2 | 7.5 | 25.0 | 25.0 | 40.0 | 40.0 | 65.0 | 25.0 | 25.0 | 50.0 |
| 4-3 | 12.5 | 20.0 | 20.0 | 45.0 | 45.0 | 65.0 | 25.0 | 25.0 | 50.0 |
| 4-4 | 17.5 | 15.0 | 15.0 | 50.0 | 50.0 | 65.0 | 25.0 | 25.0 | 50.0 |
| 4-5 | 22.5 | 10.0 | 10.0 | 55.0 | 55.0 | 65.0 | 25.0 | 25.0 | 50.0 |
| 4-6 | 27.5 | 5.0 | 5.0 | 60.0 | 60.0 | 65.0 | 25.0 | 25.0 | 50.0 |

Figure 10:
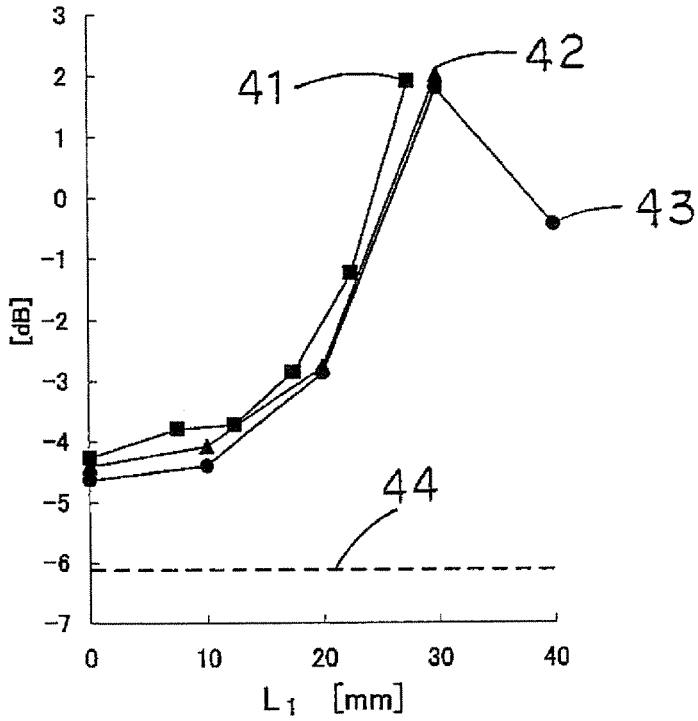
FIG. 10 is a graph of directional-gain to $L_1$-characteristic ($H_3$=25 mm) using the average values of the directional gains at 470 MHz, 530 MHz and 590 MHz with respect to some of samples shown in Table 5.

FIG. 10 is a graph of directional-gain to $L_1$-characteristics, which are shown by using the average values of the antenna gains at 470 MHz, 530 MHz, and 590 MHz with respect to some of the samples listed in Table 5. The characteristics shown in FIG. 10 are obtained when $H_3$ is set at 25 mm. Use of the average values of the antenna gains at 470 MHz, 530 MHz and 590 MHz is also applied to FIGS. 11, 12, 13 and 14 stated later.

In FIG. 10, reference numeral 41 designates the characteristics of Samples Nos. 1-1 to 1-6, reference numeral 42 designates the characteristics of Samples Nos. 2-1 to 2-4, reference numeral 43 designates the characteristics of Samples Nos. 3-1 to 3-5, and reference numeral 44 (dotted line) designates the characteristic that is obtained when all heating wires 2 are linear without including a detour 1 in FIG. 9, and that shows a Comparative Example.

Figure 11:
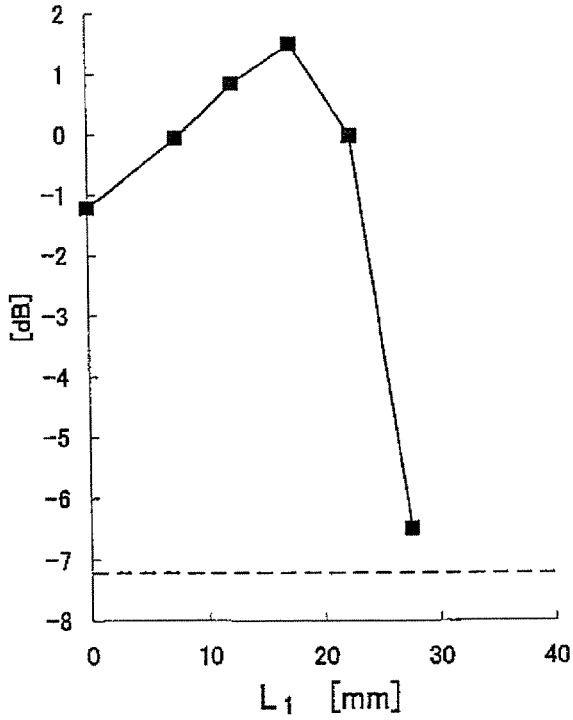
FIG. 11 is a graph of directional-gain to $L_1$-characteristic ($H_3$=50 mm), using the average values of the directional gains at 470 MHz, 530 MHz and 590 MHz with respect to Samples Nos. 4-1 to 4-6 shown in Table 5.

FIG. 11 shows a graph of a directional-gain to $L_1$-characteristic of each of Samples Nos. 4-1 to 4-6 listed in Table 5. The characteristic shown in FIG. 11 is obtained when $H_3$ is set at 50 mm. This characteristic is represented by black squares. The linear dotted line shows a characteristic which is obtained when all heating wires 2 are linear without including a detour 1 in FIG. 9, and which is a Comparative Example. This is also applicable to FIGS. 12 to 14 stated later.

Example 2 (Examples and Comparative Examples)

With respect to the spacing $P_2$ (equal spacings) between the horizontal portions (the original heating wires) of adjacent ones of the eight conductors (assumed as being the heating wires 2) except for each of the detours 1 and each pair of connection lines 9, Samples Nos. 5-1 to 5-5 are assumed as being set at 84 mm, Samples Nos. 6-1 to 6-6 are assumed as being set at 48 mm, and Samples Nos. 7-1 to 7-5 are assumed as being set at 18 mm. Calculation were made in the same way as Example 1 with the other conditions being set in the same way as Example 1. The dimensions of the respective samples are listed in Table 6 (unit: mm).

TABLE 6

| Sample No. | $L_1$ | $W_e$ | $L_3$ | $L_2$ | $W_r$ | T | $H_1$ | $H_2$ | $H_3$ |
|---|---|---|---|---|---|---|---|---|---|
| 5-1 | 0.0 | 25.0 | 25.0 | 25.0 | 25.0 | 50.0 | 35.0 | 35.0 | 70.0 |
| 5-2 | 5.0 | 20.0 | 20.0 | 30.0 | 30.0 | 50.0 | 35.0 | 35.0 | 70.0 |
| 5-3 | 10.0 | 15.0 | 15.0 | 35.0 | 35.0 | 50.0 | 35.0 | 35.0 | 70.0 |
| 5-4 | 15.0 | 10.0 | 10.0 | 40.0 | 40.0 | 50.0 | 35.0 | 35.0 | 70.0 |
| 5-5 | 20.0 | 5.0 | 5.0 | 45.0 | 45.0 | 50.0 | 35.0 | 35.0 | 70.0 |
| 6-1 | 0.0 | 45.0 | 45.0 | 45.0 | 45.0 | 90.0 | 20.0 | 20.0 | 40.0 |
| 6-2 | 10.0 | 35.0 | 35.0 | 55.0 | 55.0 | 90.0 | 20.0 | 20.0 | 40.0 |
| 6-3 | 20.0 | 25.0 | 25.0 | 65.0 | 65.0 | 90.0 | 20.0 | 20.0 | 40.0 |
| 6-4 | 30.0 | 15.0 | 15.0 | 75.0 | 75.0 | 90.0 | 20.0 | 20.0 | 40.0 |
| 6-5 | 35.0 | 10.0 | 10.0 | 80.0 | 80.0 | 90.0 | 20.0 | 20.0 | 40.0 |
| 6-6 | 40.0 | 5.0 | 5.0 | 85.0 | 85.0 | 90.0 | 20.0 | 20.0 | 40.0 |
| 7-1 | 0.0 | 60.0 | 60.0 | 60.0 | 60.0 | 120.0 | 7.5 | 7.5 | 15.0 |
| 7-2 | 20.0 | 40.0 | 40.0 | 80.0 | 80.0 | 120.0 | 7.5 | 7.5 | 15.0 |
| 7-3 | 40.0 | 20.0 | 20.0 | 100.0 | 100.0 | 120.0 | 7.5 | 7.5 | 15.0 |
| 7-4 | 50.0 | 10.0 | 10.0 | 110.0 | 110.0 | 120.0 | 7.5 | 7.5 | 15.0 |
| 7-5 | 55.0 | 5.0 | 5.0 | 115.0 | 115.0 | 120.0 | 7.5 | 7.5 | 15.0 |

Figure 12:
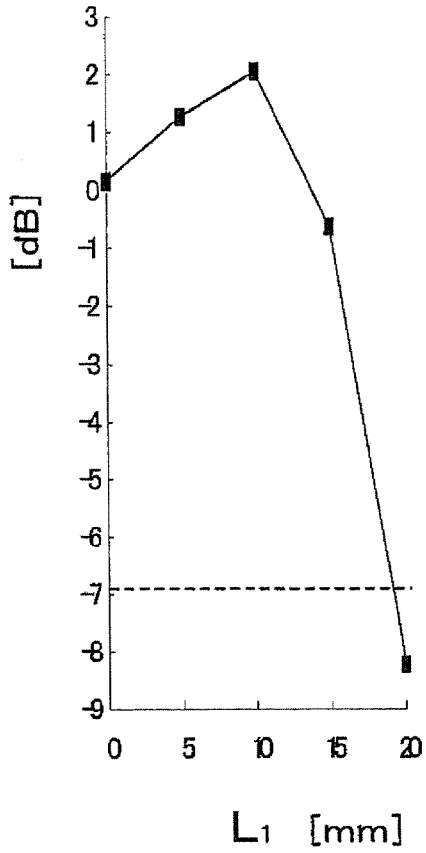
FIG. 12 is a graph of directional-gain to $L_1$-characteristic, using the average values of the directional gains at 470 MHz, 530 MHz and 590 MHz with respect to Samples Nos. 5-1 to 5-5 shown in Table 6.

FIG. 12 shows a graph of a directional-gain to $L_1$-characteristic of each of Samples Nos. 5-1 to 5-5 listed in Table 6. The characteristic shown in FIG. 12 is obtained when $H_3$ is set at 70 mm.

Figure 13:
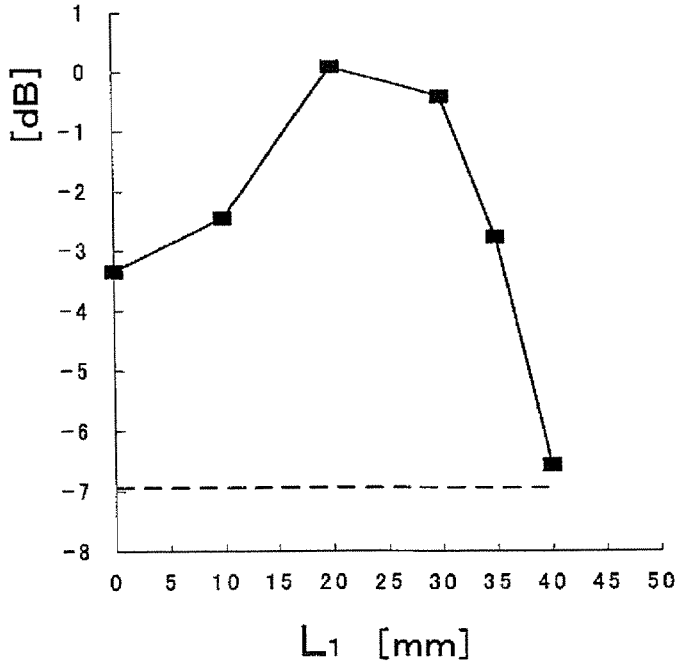
FIG. 13 is a graph of directional-gain to $L_1$-characteristic ($H_3$=40 m), using the average values of the directional gains at 470 MHz, 530 MHz and 590 MHz with respect to Samples Nos. 6-1 to 6-6 shown in Table 6.

FIG. 13 is a graph of a directional-gain to $L_1$-characteristic of each of Samples Nos. 6-1 to 6-6 listed in Table 6. The characteristic shown in FIG. 12 is obtained when $H_3$ is set at 40 mm.

Figure 14:
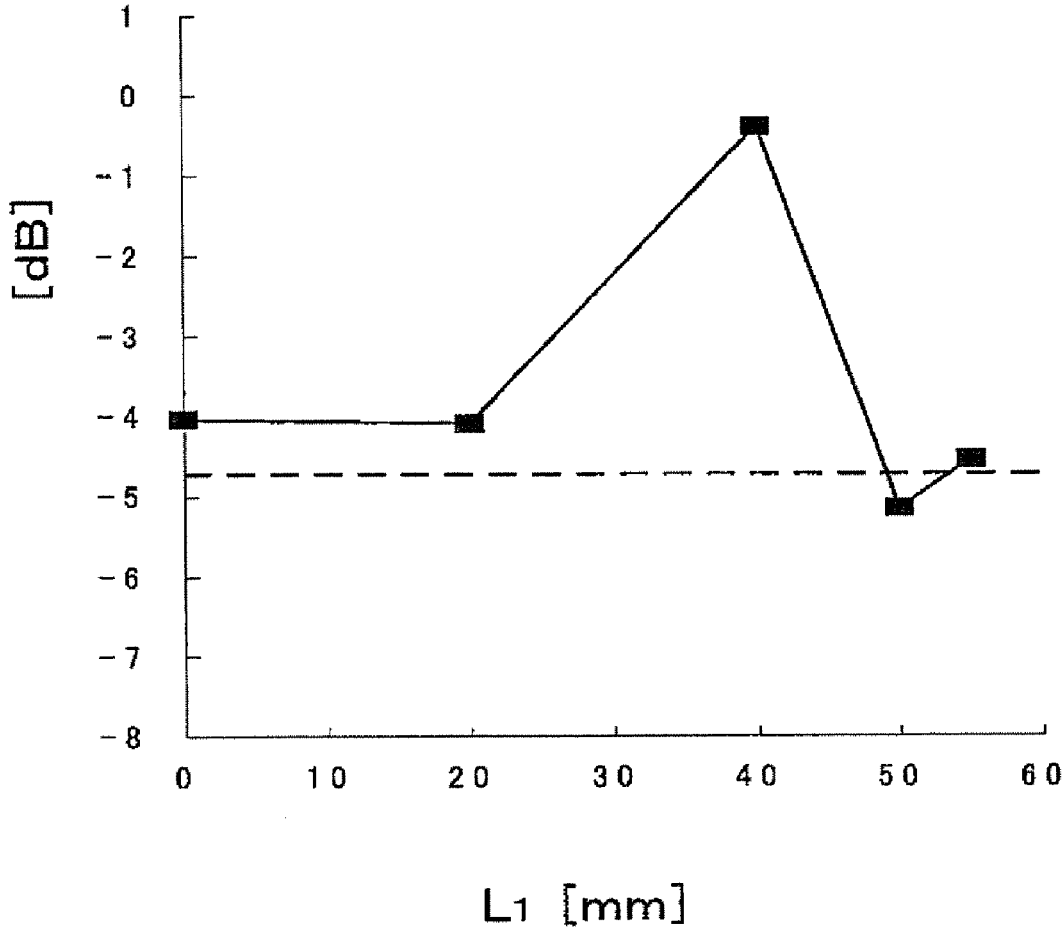
FIG. 14 is a graph of directional-gain to $L_1$-characteristic ($H_3$=15 mm), using the average values of the directional gains at 470 MHz, 530 MHz and 590 MHz with respect to Samples Nos. 7-1 to 7-5 shown in Table 6.

FIG. 14 is a graph of a directional-gain to $L_1$-characteristic of each of Samples Nos. 7-1 to 7-5 listed in Table 6. The characteristic shown in FIG. 14 is obtained when $H_3$ is set at 15 mm.

Example 3 (Example and Comparative Example)

In each sample, a high frequency wave glass antenna for an automobile as shown in FIG. 15 (seen from the car-interior-side or the car-exterior-side) was made, using a rear window glass sheet fitted into the opening for a window of an automobile (see Sample No. 8-2 stated later).

An antenna conductor 16 and a defogger were formed by sticking copper foil on the car-interior-side surface of the rear window glass sheet 14 by an adhesive, and heating wires 2 were connected to the bus bars 5*a* and 5*b* by soldering. One of the bus bars 5*a* and 5*b* is connected to the negative electrode of a DC power source. The remaining one of the bus bars is disconnected. The rear window glass sheet 14 was inclined at an angle of 26° with respect to the horizontal direction. Measurements were made for the antenna gains at the center of a rear portion of the automobile in the horizontal direction. The rear window glass sheet in this Example was symmetrical with respect to the center thereof in the left-to-right direction as the symmetrical axis.

The dimensions of respective samples are shown in Table 7 (unit: mm).

TABLE 7

| Sample No. | $L_1$ | $W_e$ | $L_3$ | $L_2$ | $W_r$ | T | $H_1$ | $H_2$ | $H_3$ |
|---|---|---|---|---|---|---|---|---|---|
| 8-1 | 0.0 | 32.5 | 32.5 | 32.5 | 32.5 | 65.0 | 12.5 | 12.5 | 25.0 |
| 8-2 | 22.5 | 10.0 | 10.0 | 55.0 | 55.0 | 65.0 | 12.5 | 12.5 | 25.0 |

The specifications of the respective parts are listed below.

| | |
|---|---|
| Width (maximum horizontal width) of upper side of rear window glass sheet | 1,115 mm |
| Width (maximum horizontal width) of lower side of rear window glass sheet | 1,315 mm |
| Thickness of rear window glass sheet | 3.5 mm |
| Dielectric constant of rear window glass sheet | 7.0 |
| Transverse width (horizontal width) $W_1$ of antenna conductor 16 | 160 mm |
| Transverse width (maximum horizontal width) of highest heating wire | 1,100 mm |
| Transverse width (maximum horizontal width) of lowest heating wire | 1,250 mm |
| Shortest spacing $P_1$ between antenna conductor 16 and highest heating wire | 64 mm |
| Shortest spacing between upper end of rear window glass sheet and antenna conductor 16 | 64 mm |
| Conductor width of antenna conductor 16 | 0.8 mm |
| Spacing $P_2$ | 30 mm |
| Conductor width of heating wire 2 | 0.8 mm |
| Conductor width of bus bars 5a and 5b | 15 mm |

A reference antenna was configured to have only an antenna conductor 16 disposed on a rear window glass sheet 14 without including a defogger. The reference antenna had the same specifications as Samples Nos. 8-1 and 8-2 except for the absence of a defogger.

Sample No. 8-1 is a Comparative Example since the detours 1 and portions of the heating wires 2 adjacent the detours 1 were formed in a meander shape because of setting $L_1$ at 0.0 mm.

Measurements were also made for a defogger, as another Comparative Example different from Sample No. 8 -1, wherein heating wires 2 had no detour 1 or no pair of connection lines, and all heating wires extended in the horizontal direction or substantially the horizontal direction (hereinbelow, referred to as the ordinary defogger sample). The ordinary defogger sample had the same specifications as Sample No. 8-2 except that no heating wires 2 had a detour 1 or a pair of connection line 9.

The measurement results were listed below.

| Antenna gain at 590 MHz: | |
|---|---|
| Ordinary defogger sample | −5.8 dB |
| Sample 8-1 | −7.3 dB |
| Sample 8-2 | −1.2 dB |

Average values of antenna gains at 470 MHz, 530 MHz and 590 MHz:

| | |
|---|---|
| Ordinary defogger sample | −6.1 dB |
| Sample 8-1 | −4.5 dB |
| Sample 8-2 | −1.5 dB |

Average values of antenna gains at 470 MHz, 530 MHz, 590 MHz, 650 MHz, 710 MHz and 770 MHz

| | |
|---|---|
| Ordinary defogger sample | −6.4 dB |
| Sample 8-1 | −4.1 dB |
| Sample 8-2 | −1.0 dB |

Example 4 (Example and Comparative Example)

In each sample, a high frequency wave glass antenna for an automobile as shown in FIG. 17 (see from the car-interior-side) was made, using a rear window glass sheet 14 fitted into the opening for a window of an automobile. Two bus bars are disposed on both sides of the rear window glass sheet 14. A left-half area of the rear window glass sheet 14 is not shown.

In each of the Examples, the antenna conductor and the defogger was formed by sticking copper foil on the car-interior-side surface of the rear window glass sheet 14 by an adhesive, and the joining heating wires 53 and 54 were connected to the bus bar 5*a* by soldering. The bus bar 5*a* was connected to the negative electrode of a DC power source (not shown). The other bus bar was disconnected. The rear window glass sheet 14 was inclined at an angle of 22.6° with respect to the horizontal direction.

The antenna gains were represented by antenna gain average values (every 3°) within −90° to +90° in the horizontal direction (automobile backside) when the center of a rear portion of the automobile was set at 0 (zero)°, the right direction of the automobile is set at +90° and the center of a front portion of the automobile is set at +180°. The measurement frequencies were set at 473 to 575 MHz (every 6 MHz), 587 MHz and 605 to 713 MHz (every 18 MHz), and the antenna gain average values at these frequencies are shown below.

(1) The average value of the antenna gains of an ordinary defogger (Comparative Example: defogger, which is configured so that no heating wires have a detour or a pair of connection lines formed therein in the case shown in FIG. 17, and which, for example, is configured in the same shape as portions of the heating wires 2 adjacent the bus bar 5*a* in the case shown in FIG. 15): −7.7 dBd (2) The average value of the antenna gains of a mode, wherein the island-shaped conductors 58 and 59 are disposed in the case (Example) shown in FIG. 17 (seen from the car-interior-side): −6.5 dBd (3) The average value of the antenna gains of a mode, wherein no island-shaped conductors 58 and 59 are disposed in the case (Example) shown in FIG. 17 (seen from the car-interior-side).

| | |
|---|---|
| $H_1$ | about 30 mm |
| $H_2$ | about 30 mm |
| $H_3$ | about 60 mm |
| $L_1$ | 15 mm |
| $L_2$ | 45 mm |

-continued

| | |
|---|---|
| $L_3$ | 15 mm |
| $W_e$ | 15 mm |
| $W_r$ | 45 mm |
| Conductor length of first antenna element 56b | 320 mm |
| $L_{50}$ | 80 mm |
| $L_{51}$ | 130 mm |
| $L_{52}$ | 60 mm |
| $L_{53}$ | 45 mm |
| $D_{50}$ | 10 mm |
| $D_{51}$ | 35 mm |
| $D_{52}$ | 45 mm |
| $D_{53}$ | 15 mm |
| $D_{54}$ | 20 mm |
| Conductor length of first island-shaped conductor 58 | 70 mm |
| Conductor length of second island-shaped conductor 59 | 70 mm |
| Spacing between adjacent heating wires 2a, 2b, 2c, 2d and 2e | about 30 mm |
| Line width of heating wires 2a, 2b, 2c, 2d and 2e | 0.7 mm |
| Line width of first joining heating wire 53 | 4.5 mm |
| Line width of second joining heating wire 54 | 4.5 mm |
| Line width of first short-circuit heating wire 52a | 3 mm |
| Line width of second short-circuit heating wire 52b | 3 mm |
| Conductor width of bus bar 5a | 12 mm |
| Number of heating wires at center of rear window glass sheet in left-to-right direction | 18 |

Plotting in FIG. 16

The relationship between $L_1$ and $H_3$ is shown in the plane of coordinates of FIG. 16, which represents $L_1$ as the vertical axis and $H_3$ as the horizontal axis. In FIG. 16, the respective straight lines are determined as stated below.

In order to determine a short range for $L_1$, the point, at which $L_1$ is 5 mm in FIG. 10 ($H_3$=25 mm), and the point, at which $L_1$ is 0 (zero) mm in FIG. 11 ($H_3$=50 mm), are connected by a straight line, and this straight line is called a straight line A1. In order to determine a shorter range for $L_1$, the point, at which $L_1$ is 15 mm in FIG. 10, and the point, at which $L_1$ is 0 (zero) mm in FIG. 11, are connected by a straight line, and this straight line is called a straight line B1.

In order to determine a long range for $L_1$, the point, at which $L_1$ is 40 mm in FIG. 10, and the point, at which $L_1$ is 26 mm in FIG. 11 ($H_3$=50 mm), are connected by a straight line, and this straight line is called a straight line A2. In order to a longer range for $L_1$, the point, at which $L_1$ is 38 mm in FIG. 10, and the point, at which $L_1$ is 22.5 mm in FIG. 10 ($H_3$=50 mm), are connected by a straight line, and this straight line is called a straight line B2.

Straight lines A4, A5, B4 and B5 are determined based on Table 3. Straight lines A3 and B3 are determined based on the numerical limitation for $L_1$ stated above. Preferred regions among the characteristics shown in FIG. 12, FIG. 13 and FIG. 14 are contained in the range surrounded by the straight lines A1 to A5.

INDUSTRIAL APPLICABILITY

The present invention is applicable to a glass antenna for an automobile, which receives a digital terrestrial television broadcast, an analog television broadcast and a US digital television broadcast in the UHF band, an EU digital television broadcast or a Chinese digital television broadcast. The present invention is also applicable to the Japanese FM broadcast band (76 to 90 MHz), the US FM broadcast band (88 to 108 MHz), the television VHF band (90 to 108 MHz and 170 to 222 MHz), the 800 MHz band for automobile telephones (810 to 960 MHz), the 1.5 GHz band for automobile telephones (1.429 to 1.501 GHz), the UHF band (300 MHz to 3

GHz), the GPS (Global Positioning System), the GPS signal for artificial satellites (1,575.42 MHz) and the VICS (Vehicle Information and Communication System: 2.5 GHz).

Further, the present invention is applicable to the ETC communication (Electronic Toll Collection System: non-stop automatic fare collection system, transmit frequency of roadside wireless equipment: 5.795 GHz or 5.805 GHz, reception frequency of roadside wireless equipment: 5.835 GHz or 5.845 GHz), the DSRC (Dedicated Short Range Communication in the 915 MHz band, the 5.8 GHz band and the 60 GHz band), communication using a microwave (1 GHz to 3 THz), communication using millimeter wave (30 to 300 GHz), communication for the automobile keyless entry system (300 to 450 MHz), and communication for the SDARS (Satellite Digital Audio Radio Service (2.6 GHz)).

The entire disclosure of Japanese Patent Application No. 2006-115701 filed on Apr. 19, 2006 including specification, claims, drawings and summary is incorporated herein by reference in its entirety.

What is claimed is:

1. A high frequency wave glass antenna for an automobile, comprising a plurality of heating wires and a plurality of bus bars for feeding the heating wires, disposed in or on an automobile rear widow glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper margin of the rear widow glass sheet except for a defogger region;

further comprising:

at least one of the heating wires having a detour formed at one or more locations therein;

a heating wire with the detour, having an inlet connected to the detour; and both ends of the inlet connected to both ends of the detour directly or through a pair of connection lines;

wherein in a case where both ends of the inlet are connected to both ends of the detour through the paired connection lines, a shorter one of the shortest spacing between the paired connection lines and the shortest spacing between both ends of the inlet is called $W_e$; and in a case where both ends of the inlet are connected to both ends of the detour directly, the shortest spacing between both ends of the inlet is called $W_e$;

when a maximum width of the detour in a horizontal direction is call $W_r$, a received frequency has $\lambda_0$ in the air, and the formula of $\{(W_r-W_e)/2\}=L_1$ is established, the formula of $L_1 \geqq 0.0053 \cdot \lambda_0$ is satisfied.

2. A high frequency wave glass antenna for an automobile, comprising a plurality of heating wires and a plurality of bus bars for feeding the heating wires, disposed in or on an automobile rear widow glass sheet, the heating wires and the bus bars forming a defogger, the heating wires extending in a horizontal direction, a substantially horizontal direction, a direction along an upper edge of the rear window glass sheet or a direction along a lower edge of the rear window glass sheet; and an antenna conductor disposed in an upper margin of the rear widow glass sheet except for a defogger region;

further comprising:

the highest heating wire and the second highest heating wire just under the highest heating wire, which are disposed in a central portion of the rear window glass sheet in a left-to-right direction, and which have leading edges connected by a short-circuit heating wire without reaching one of the bus bars;

a joining heating wire extending toward the one bus bar, beginning at the short-circuit heating wire, and reaching and being connected to the one bus bar;

a detour formed at one or more locations in the joining heating wire;

the joining heating wire having an inlet connected to the detour; and both ends of the inlet connected to both ends of the detour directly or through a pair of connection lines;

wherein in a case where both ends of the inlet are connected to both ends of the detour through the paired connection lines, a shorter one of the shortest spacing between the paired connection lines and the shortest spacing between both ends of the inlet is called $W_e$; and in a case where both ends of the inlet are connected to both ends of the detour directly, the shortest spacing between both ends of the inlet is called $W_e$;

when a maximum width of the detour in a horizontal direction is call $W_r$, a received frequency has $\lambda_0$ in the air, and the formula of $\{(W_r-W_e)/2\}=L_1$ is established, the formula of $L_1 \geqq 0.0053 \cdot \lambda_0$ is satisfied.

3. The glass antenna according to claim 1, wherein $W_r$ and $L_1$ satisfy the formula of $(L_1/W_r) \geqq 0.02$.

4. The glass antenna according to claim 2, wherein $W_r$ and $L_1$ satisfy the formula of $(L_1/W_r) \geqq 0.02$.

5. The glass antenna according to claim 1, wherein the formula of $L_1 \geqq 3$ mm is satisfied.

6. The glass antenna according to claim 2, wherein the formula of $L_1 \geqq 3$ mm is satisfied.

7. The glass antenna according to claim 1, wherein in a case where it is assumed that there is a first straight line, which extends parallel to a plane parallel to a longitudinal direction of the automobile and a vertical direction, which has contact with a right edge of the antenna conductor, and which passes through at least one of the heating wires, the first straight line is called a first imaginary straight line; and in a case where it is assumed that there is a second straight line, which extends parallel to the plane parallel to the longitudinal direction of the automobile and the vertical direction, which has contact with a left edge of the antenna conductor, and which passes through at least one of the heating wires, the second straight line is called a second imaginary straight line;

when the detour is disposed at one location, the detour is partly or entirely disposed between the first imaginary straight line and the second imaginary straight line as viewed three-dimensionally;

when the detour is disposed at plural locations, at least one of the detours is partly or entirely disposed between the first imaginary straight line and the second imaginary straight line as viewed three-dimensionally.

8. The glass antenna according to claim 1, wherein in a case where a received broadcast frequency band is within a range of 300 to 1,000 MHz; and where a frequency band, which has the difference between a maximum frequency and a minimum frequency ranging from 91 to 169 MHz, is called a specific frequency band;

when the broadcast frequency band contains the specific frequency band, or when the broadcast frequency band accords with the specific frequency band;

at least one of the frequencies existing in the specific frequency band is received; and in a case where a center frequency in the specific frequency band has a wavelength of $\lambda_c$ in the air;

when a horizontal portion, a substantially horizontal portion, a portion extending in the direction along the upper edge of the rear window glass sheet or a portion extending in the direction along the lower edge of the rear window glass sheet in the entirety of each of the heating wires except for the detour and the paired connection lines is called an original heating wire;

when the paired connection lines are disposed, the vertical width of a shape, which is formed by the detour and the paired connection lines and extends in a direction vertical to the original heating line, is called $H_3$; and when no paired connection lines are disposed, the vertical width of the detour, which is vertical to the original heating wire, is called $H_3$;

the formula of $0.022\lambda_c \leqq H_3 \leqq 0.186\lambda_c$ is satisfied.

9. The glass antenna according to claim 2, wherein in a case where a received broadcast frequency band is within a range of 300 to 1,000 MHz; and where a frequency band, which has the difference between a maximum frequency and a minimum frequency ranging from 91 to 169 MHz, is called a specific frequency band;

when the broadcast frequency band contains the specific frequency band, or when the broadcast frequency band accords with the specific frequency band;

at least one of the frequencies existing in the specific frequency band is received; and in a case where a center frequency in the specific frequency band has a wavelength of $\lambda_c$ in the air;

when the paired connection lines are disposed, the vertical width of a shape, which is formed by the detour and the paired connection lines and extends in a direction vertical to the joining heating line, is called $H_3$; and when no paired connection lines are disposed, the vertical width of the detour, which is vertical to the joining heating wire, is called $H_3$;

the formula of $0.022\lambda_c \leqq H_3 \leqq 0.186\lambda_c$ is satisfied.

10. The glass antenna according to claim 1, wherein in a case where a horizontal portion, a substantially horizontal portion, a portion extending in the direction along the upper edge of the rear window glass sheet or a portion extending in the direction along the lower edge of the rear window glass sheet in the entire portion of each of the heating wires except for the detour and the paired connection lines is called an original heating wire;

when the paired connection lines are disposed, the vertical width of a shape, which is formed by the detour and the paired connection lines and extends in a direction vertical to the original heating line, is called $H_3$; and when no paired connection lines are disposed, the vertical width of the detour, which is vertical to the original heating wire, is called $H_3$;

the formula of 12.5 mm$\leqq H_3 \leqq$105 mm is satisfied.

11. The glass antenna according to claim 1, wherein in a case where a received broadcast frequency band within a range of 300 to 1,000 MHz; and where a frequency band, which has the difference between a maximum frequency and a minimum frequency ranging from 91 to 169 MHz, is called a specific frequency band;

when the broadcast frequency band contains the specific frequency band, or when the broadcast frequency band accords with the specific frequency band;

at least one of the frequencies existing in the specific frequency band is received; and in a case where a center frequency in the specific frequency band has a wavelength of $\lambda_c$ in the air;

when a horizontal portion, a substantially horizontal portion, a portion extending in the direction along the upper edge of the rear window glass sheet or a portion extending in the direction along the lower edge of the rear window glass sheet in the entire portion of each of the heating wires except for the detour and the paired connection lines is called an original heating wire;

when the paired connection lines are disposed, the vertical width of a shape, which is formed by the detour and the paired connection lines and extends in a direction vertical to the original heating line is called $H_3$; and when no paired connection lines are disposed, the vertical width of the detour, which is vertical to the original heating wire, is called $H_3$;

$L_1$ and $H_3$ exist in a range surrounded by a straight line $A_\lambda$1, a straight line $A_\lambda$2, a straight line $A_\lambda$3, a straight line $A_\lambda$4 and a straight line $A_\lambda$5 in a plane of coordinates, whose vertical axis and horizontal axis represent $L_1$ and $H_3$, respectively

| | |
|---|---|
| $L_1 = -0.2 \cdot H_3 + 0.018\ \lambda_c$: | the straight line $A_\lambda 1$ |
| $L_1 = -(14/25) \cdot H_3 + 0.096\ \lambda_c$: | the straight line $A_\lambda 2$ |
| $L_1 = 0.0053 \cdot \lambda_c$: | the straight line $A_\lambda 3$ |
| $H_3 = 0.134 \cdot \lambda_c$: | the straight line $A_\lambda 4$ |
| $H_3 = 0.022 \cdot \lambda_c$: | the straight line $A_\lambda 5$. |

12. The glass antenna according to claim 1, wherein at least one of frequencies ranging 470 to 600 MHz is received; and wherein in a case where a horizontal portion, a substantially horizontal portion, a portion extending in the direction along the upper edge of the rear window glass sheet or a portion extending in the direction along the lower edge of the rear window glass sheet in the entire portion of each of the heating wires except for the detour and the paired connection lines is called an original heating wire;

when the paired connection lines are disposed, the vertical width of a shape, which is formed by the detour and the paired connection lines and extends in a direction vertical to the original heating line is called $H_3$; and when no paired connection lines are disposed, the vertical width of the detour, which is vertical to the original heating wire, is called $H_3$;

$L_1$ and $H_3$ exist in a range surrounded by a straight line A1, a straight line A2, a straight line A3, a straight line A4 and a straight line A5 in a plane of coordinates, whose vertical axis and horizontal axis represent $L_1$ and $H_3$, respectively

| | |
|---|---|
| $L_1 = -0.2 \cdot H_3 + 10$ mm: | the straight line A1 |
| $L_1 = -(14/25) \cdot H_3 + 54$ mm: | the straight line A2 |
| $L_1 = 3$ mm: | the straight line A3 |
| $H_3 = 75$ mm: | the straight line A4 |
| $H_3 = 12.5$ mm: | the straight line A5. |

13. The glass antenna according to claim 1, wherein in a case where a received broadcast frequency band is within a range of 300 to 1,000 MHz; and where a frequency band, which has the difference between a maximum frequency and a minimum frequency ranging from 91 to 169 MHz, is called a specific frequency band;

when the broadcast frequency band contains the specific frequency band, or when the broadcast frequency band accords with the specific frequency band;

at least one of the frequencies existing in the specific frequency band is received;

wherein at least one of the heating wires has the detour formed at plural locations therein, and a spacing between the centers or the centers of gravity of adjacent detours as a period between adjacent detours is called T; and wherein in a case where a center frequency in the specific frequency band has a wavelength of $\lambda_c$ in the air, where the formula of $(W_r-0.4\text{ mm})/2=t_c$ is established, and where the formula of $(T-W_e-0.4\text{ mm})/2=t_d$ is established;

when a horizontal portion, a substantially horizontal portion, a portion extending in the direction along the upper edge of the rear window glass sheet or a portion extending in the direction along the lower edge of the rear window glass sheet in the entire portion of each of the heating wires except for the detour and the paired connection lines is called an original heating wire;

when the paired connection lines are disposed, the vertical width of a shape, which is formed by the detour and the paired connection lines and extends in a direction vertical to the original heating line, is called $H_3$; and when no paired connection lines are disposed, the vertical width of the detour, which is vertical to the original heating wire, is called $H_3$, the formula of $L_1=0.0089\lambda_c$ to X is satisfied in a range of $0.022\lambda_c \leqq H_3 \leqq 0.134\lambda_c$;

wherein X is the shortest one among $(-(14/25)\cdot H_3+0.0961\lambda_c)$, $t_c$ and $t_d$.

14. The glass antenna according to claim 11, wherein the specific frequency band ranges 470 to 600 MHz.

15. The glass antenna according to claim 1, wherein the detour is formed in such a semi-loop shape that a discontinuity is formed in a portion of a loop shape, and that both ends of the detour are both ends of the discontinuity.

16. The glass antenna according to claim 1, wherein the detour is formed in such a shape as to have a cut-out portion like something that has a portion of a polygonal shape or substantially polygonal shape cutout therein; and wherein both ends of the detour are both ends of the cut-out portion.

17. The glass antenna according to claim 16, wherein the cut-out portion is located at one side of the polygonal shape or substantially polygonal shape.

18. The glass antenna according to claim 16, wherein the polygonal shape or substantially polygonal shape is a square shape or substantially square shape.

19. The glass antenna according to claim 15, wherein the side opposite a side with the discontinuity being formed therein extends horizontally or substantially horizontally.

20. The glass antenna according to claim 1, wherein the detour is formed in such a C-character shape or substantially C-character shape that both ends of the detour are both ends of the C-character shape or substantially C-character shape.

21. The glass antenna according to claim 1, wherein the detour is formed in such a shape as to have branch lines connected to both ends of a U-character shape, substantially U-character shape, characterized C-character shape or substantially characterized C-character shape;

wherein when the two branch lines are called a first branch line and a second branch line, the first branch line and the second branch line extend in such directions so as to be brought close to each other; and wherein an end of the first branch line close to the second branch line and an end of the second branch line close to the first branch line are both ends of the detour, respectively.

22. The glass antenna according to claim 21, wherein the first branch line and the second branch line comprise horizontal or substantially horizontal straight lines.

23. The glass antenna according to claim 1, wherein the detour is formed in such a shape as to have a cut-out portion like something that has a portion of the arch of a circular shape, substantially circular shape, oval shape or substantially oval shape cutout therein; and wherein both ends of the cut-out portion are both ends of the detour.

24. The glass antenna according to claim 23, wherein when the detour is formed in such a shape as to have a cut-out portion like something that has a portion of the arch of an oval shape or substantially oval shape cutout therein, an intersection of the minor axis of the oval shape or substantially oval shape and the arch of the minor axis of the oval shape or substantially oval shape is contained in the cut-out portion.

25. The glass antenna according to claim 1, wherein the detour is formed in such a shape as to have a cut-out portion like something that has a portion containing an apex of a triangular shape or substantially triangular shape, cutout therein; and wherein both ends of the detour are both ends of the cut-out portion.

26. The glass antenna according to claim 25, wherein the side opposite the apex is horizontal or substantially horizontal.

27. The glass antenna according to claim 1, wherein in a case where the spacing between horizontal or substantially horizontal portions of adjacent heating wires except for the detour and paired connection lines is called an original heating wire spacing;

when no paired connection lines are disposed in connection with the detour, and when both ends of the inlet are respectively connected directly to both ends of the detour, the vertical width of the detour is shorter than the original heating wire spacing; and when the paired connection lines are disposed in connection with the detour, and when both ends of the inlet are respectively connected to both ends of the detour through the paired connection lines, the vertical width of a shape formed by the detour and the paired connection lines is shorter than the original heating wire spacing.

28. The glass antenna according to claim 27, wherein the original heating wire spacing is 15 to 60 mm.

29. The glass antenna according to claim 1, wherein $\lambda_0$ is the center frequency of a digital terrestrial television broadcast band.

30. The glass antenna according to claim 1, wherein the antenna conductor and the detour have an island-shaped conductor disposed therebetween.

31. The glass antenna according to claim 1, wherein the detour has an island-shaped conductor disposed just thereunder.

32. The glass antenna according to claim 30, wherein the island-shaped conductor includes a linear conductor or a substantially linear conductor.

33. The glass antenna according to claim 30, wherein the island-shaped conductor includes a square-loop shape conductor, a substantially square-loop shape conductor, an L-character shape conductor, a substantially L-character shape conductor, a left-right reversed L-character shape conductor, a left-right reversed substantially L-character shape conductor, a U-character shape conductor, a substantially U-character shape conductor, an upside-down U-character shape conductor, an upside-down, substantially U-character shape conductor, a lying U-shape conductor, a lying substantially U-character shape conductor, a left-right reversed, lying U-character shape conductor, a left-right reversed, substantially lying U-character shape conductor, an upside-down L-character shape conductor, an upside-down, substantially L-character shape conductor, an upside-down, left-right reversed L-character shape conductor or an upside-down, left-right reversed, substantially L-character shape conductor.

34. The glass antenna according to claim 30, wherein a maximum width of the island-shaped conductor in the horizontal direction is 30 to 150 mm.

35. The glass antenna according to claim 30, the shortest spacing between the antenna conductor and the island-shaped conductor is 1 to 100 mm.

36. The glass antenna according to claim 30, wherein the shortest spacing between the defogger and the island-shaped conductor is 5 to 50 mm.

37. The glass antenna according to claim 1, wherein the antenna conductor has a function of receiving a digital television broadcast band.

38. The glass antenna according to claim 2, wherein the antenna conductor has a function of receiving a digital television broadcast band.

39. The glass antenna according to claim 1, wherein the rear glass window glass sheet has a dielectric film disposed thereon, and at least one of the antenna conductor and the defogger is partly or entirely disposed on the dielectric film.

40. The glass antenna according to claim 1, a received radio wave contains a frequency ranging from 470 to 770 MHz.

41. The glass antenna according to claim 1, wherein a received radio wave contains a frequency ranging from 470 to 600 MHz.

42. The glass antenna according to claim 1, wherein a received radio wave contains a frequency ranging from 698 to 806 MHz.

43. A rear window glass sheet for an automobile including the antenna conductor and the defogger recited in claim 1.

* * * * *